US009085150B2

(12) United States Patent
Aoyama

(10) Patent No.: US 9,085,150 B2
(45) Date of Patent: Jul. 21, 2015

(54) INK JET RECORDING METHOD AND INK USED FOR THE SAME

(75) Inventor: Tetsuya Aoyama, Shiojiri (JP)

(73) Assignee: Seiko Epson Corporation, Shiojiri-Shi (JP)

( * ) Notice: Subject to any disclaimer, the term of this patent is extended or adjusted under 35 U.S.C. 154(b) by 0 days.

(21) Appl. No.: 13/367,604

(22) Filed: Feb. 7, 2012

(65) Prior Publication Data

US 2012/0200633 A1 Aug. 9, 2012

(30) Foreign Application Priority Data

Feb. 7, 2011 (JP) ..... 2011-024330

(51) Int. Cl.
*B41J 2/015* (2006.01)
*B41J 2/155* (2006.01)

(52) U.S. Cl.
CPC ..... *B41J 2/155* (2013.01)

(58) Field of Classification Search
CPC ..... B41J 2/155
USPC ..... 347/20, 100
See application file for complete search history.

(56) References Cited

U.S. PATENT DOCUMENTS 4,951,067 A * 8/1990 Spehrley, Jr. ..... 347/102
5,256,192 A * 10/1993 Liu et al. ..... 106/31.15
5,510,822 A * 4/1996 Vincent et al. ..... 347/102
6,087,416 A 7/2000 Pearlstine et al.
6,439,687 B1 * 8/2002 Inoue ..... 347/41
7,156,909 B2 1/2007 Oyanagi et al.
7,338,988 B2 3/2008 Hesler et al.
8,403,453 B2 * 3/2013 Takabayashi ..... 347/20
2002/0171726 A1 * 11/2002 Ishii et al. ..... 347/101
2005/0176847 A1 8/2005 Cagle
2012/0040155 A1 * 2/2012 Komatsu et al. ..... 428/204

FOREIGN PATENT DOCUMENTS

JP 11-129613 A 5/1999
JP 11-140365 A 5/1999
JP 2000/044858 A 2/2000
JP 2001/234093 A 8/2001
JP 2002-225254 A 8/2002
JP 3937170 A 6/2004
JP 2005-220352 A 8/2005

(Continued)

*Primary Examiner* — Alessandro Amari
*Assistant Examiner* — Michael Konczal
(74) *Attorney, Agent, or Firm* — Nutter McClennen & Fish LLP; John J. Penny, Jr.; Taylor M. Coon

(57) ABSTRACT

An ink jet recording method includes forming an image on a print medium by discharging a specific ink; and transporting the print medium, wherein the forming and the transporting are alternatively performed for printing; in the forming an image, while a print head is moved relative to the print medium that stops in the printing area, scanning for discharging the ink from the print head to the print medium is performed a plurality of times, and the specific ink discharged to the print medium is fixed to the print medium by being supplied with energy; the print medium is a non-ink-absorptive or low-ink-absorptive print medium; and the specific ink contains 60% by mass or more of one or more kinds of organic solvent that have a boiling point of 120° C. to 240° C. and are selected from a group consisting of glycol ether-based solvents and non-protonic polar solvents in the ink.

16 Claims, 8 Drawing Sheets

(56) References Cited

FOREIGN PATENT DOCUMENTS

| | | | |
|---|---|---|---|
| JP | 2009-090635 | A | 4/2009 |
| JP | 2009-114301 | A | 5/2009 |
| JP | 4308526 | B2 | 8/2009 |
| WO | 02-055619 | | 7/2002 |

* cited by examiner

INK JET RECORDING METHOD AND INK USED FOR THE SAME

BACKGROUND

1. Technical Field

The present invention relates to an ink jet recording method and an ink used for the same.

2. Related Art

An ink jet recording method is a recording method for forming images by attaching ink droplets to a print medium such as paper by means of flying (discharging) the ink droplets. Due to the innovative progress of ink jet recording technologies in recent years, the ink jet recording method has become applicable so far in the field of high-definition printing (image formation) which has been conducted by silver halide photography and offset printing. Therefore, as one of the characteristics required for the ink jet recording method, the responsiveness to printing on various print media having poor ink absorbability, such as film substrates based on polyvinyl chloride and olefin, has become an important issue.

For the ink for the offset printing used in the related art, as low boiling point solvents that have been widely used as organic solvents, aromatic hydrocarbon such as toluene and xylene; aliphatic hydrocarbon such as hexane and kerosene; ketones such as methyl ethyl ketone; esters such as ethyl acetate; propylene glycol monomethyl ether acetate and the like have been used in general. However, when printing is performed on a polyvinyl chloride substrate as a print medium by using the ink including such organic solvents, since these organic solvents have low boiling and flash points and strong odor, the ink is not preferable in terms of an operator's safety. In addition, there is a problem in that nozzles are easily clogged since the ink is dried rapidly, and that print specifications have high costs for reasons of dissolution and swelling with respect to plastic (for example, a polystyrene resin, an ABS resin, and the like) used for apparatuses and components such as ink storage container and a printer. Moreover, when printing is performed on the polyvinyl chloride substrate or the like, printing quality and a drying property of printing are not satisfactory.

Regarding a recording method that forms images on non-ink-absorptive and low-ink-absorptive print media by means of the ink jet recording method, JP-A-2000-44858 suggests a method in which an ink including water, a glycol-based solvent, an insoluble colorant, a polymeric dispersant, a silicon-based surfactant, a fluorinated surfactant, a water-insoluble graft copolymer binder, and N-methylpyrrolidone is printed on a hydrophobic substrate. Japanese Patent No. 3937170 suggests a method in which an ink including an aqueous emulsion polymer having a glass transition temperature of 40° C. to 80° C., a pigment, and a water-soluble surface agent selected from monoalkyl ether of an alkylene glycol, 2-pyrrole, N-methylpyrrolidone, and sulfolane provides images on a hydrophobic surface. JP-A-2005-220352 suggests a polymer colloid-containing ink jet ink to be printed on a non-porous substrate, which includes a volatile co-solvent having a boiling point of 285° C. or less, acid-functionalized polymer colloid particles, and a pigment colorant. Japanese Patent No. 4308526 discloses a non-aqueous ink composition for ink jet recording which includes a mixture of a diethylene glycol compound and dipropylene glycol compound that stays liquid at a normal temperature and pressure in a predetermined mixing ratio.

However, the solvents such as the diethylene glycol compound and propylene glycol compound used in Japanese Patent No. 4308526 are problematic in terms of landing accuracy (discharge reliability).

As the ink used in the ink jet recording method, an aqueous ink results in poor image quality and a fixing property when forming images on a non-absorptive print medium. Accordingly, this leads to a problem that the printing speed and recording method are restricted. Meanwhile, the non-aqueous ink using a high boiling point solvent has a poor drying property, compared to a non-aqueous ink using a low boiling point solvent. Accordingly, this leads to a problem that the printing speed and recording method are restricted, and that the image quality deteriorates.

The problem of image quality mainly results from the drying property of an ink, and the drying property is a factor of the fixing property and tackiness.

SUMMARY

An advantage of some aspects of the invention is to provide a recording method that forms images on non-ink absorptive and low-ink-absorptive print media by using an ink which uses a high boiling point solvent, by means of an ink jet recording method. This ink jet recording method is excellent in image quality and fixing property regardless of ink absorbability of the print medium, and excellent in high speed printing properties (tackiness and drying property) and discharge stability.

To offer the above-described advantage, the present inventors conducted a thorough investigation, and as a result, they found that there was compatibility between a printer and an ink used for the recording method. Therefore, they examined what type of ink needs to be used in a certain printer in the recording method that can offer the above-described advantage. As a result, they found that, in an apparatus printing on a print medium that stops on a platen equipped with a drying mechanism, by using a specific non-aqueous ink, which contains a predetermined amount or more of a predetermined organic solvent having a boiling point in a predetermined range in the ink composition, the recording method that can offer the above-described advantage can be realized. In this manner, the inventors have completed the invention.

That is, the invention is as follows.

(1) According to an aspect of the invention, there is provided an ink jet recording method including: forming an image on a print medium positioned in a printing area by discharging a specific ink; and transporting the print medium, wherein the forming and the transporting are alternatively performed for printing; in the forming of an image, while a print head is moved relative to the print medium that stops in the printing area, scanning for discharging the ink from the print head to the print medium is performed a plurality of times, and the specific ink discharged to the print medium is fixed to the print medium by being supplied with energy; the print medium is a non-ink-absorptive or low-ink-absorptive print medium; and the specific ink contains 60% by mass or more of one or more kinds of organic solvent that have a boiling point of 120° C. to 240° C. and are selected from a group consisting of glycol ether-based solvents and non-protonic polar solvents in the ink composition.

(2) In the ink jet recording method according to (1), the scanning in the forming of an image moves the print head relative to the print medium that stops in the printing area along a predetermined direction, while causing the print head to discharge the specific ink to the print medium.

(3) In the ink jet recording method according to (2), in the forming of an image, scanning for moving the print head in the predetermined direction, and an operation of moving the print head relative to the print medium in a direction crossing the predetermined direction are alternatively performed.

(4) In the ink jet recording method according to (2) or (3), the print head is provided with nozzle columns in which a plurality of nozzles having a predetermined nozzle density line up, in the direction crossing the predetermined direction, and whenever the forming of an image is performed once, printing is performed with a printing resolution higher than the nozzle density of the print head in a direction crossing the predetermined direction.

(5) In the ink jet recording method according to any one of (2) to (4), the print head is provided with nozzle columns in which a plurality of nozzles line up in a direction crossing the predetermined direction, and a length in the direction crossing the predetermined direction of the nozzle columns is longer than a length in the direction crossing the predetermined direction of the print medium positioned in the printing area.

(6) According to another aspect of the invention, there is provided an ink used for the ink jet recording method according to any one of (1) to (5).

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the embodiments of the invention will be described in detail.

In the present specification, "image printing" refers to an image printing operation performed once or more over an entire print medium, and "image formation" refers to an image printing operation performed once while the print medium stops. "Scanning of a head" refers to one operation in which ink is discharged while a head is moved relative to the print medium along a predetermined direction during the image formation.

In the present specification, "drying property" refers to a property in which an ink is attached onto the print medium and dried, and "fixing property" refers to a property in which an ink is not peeled off from the print medium after being attached onto the print medium and dried. "Tackiness" refers to a property (tack-free) in which a trace does not remain even if a printed portion is touched with a finger immediately after printing.

Recording Method

A first embodiment of the invention relates to a recording method. Hereinafter, a printer will be described in detail, which is used for the recording method and scans a plurality of times and completes image printing while stopping.

Configuration of Printer

Figure 1:
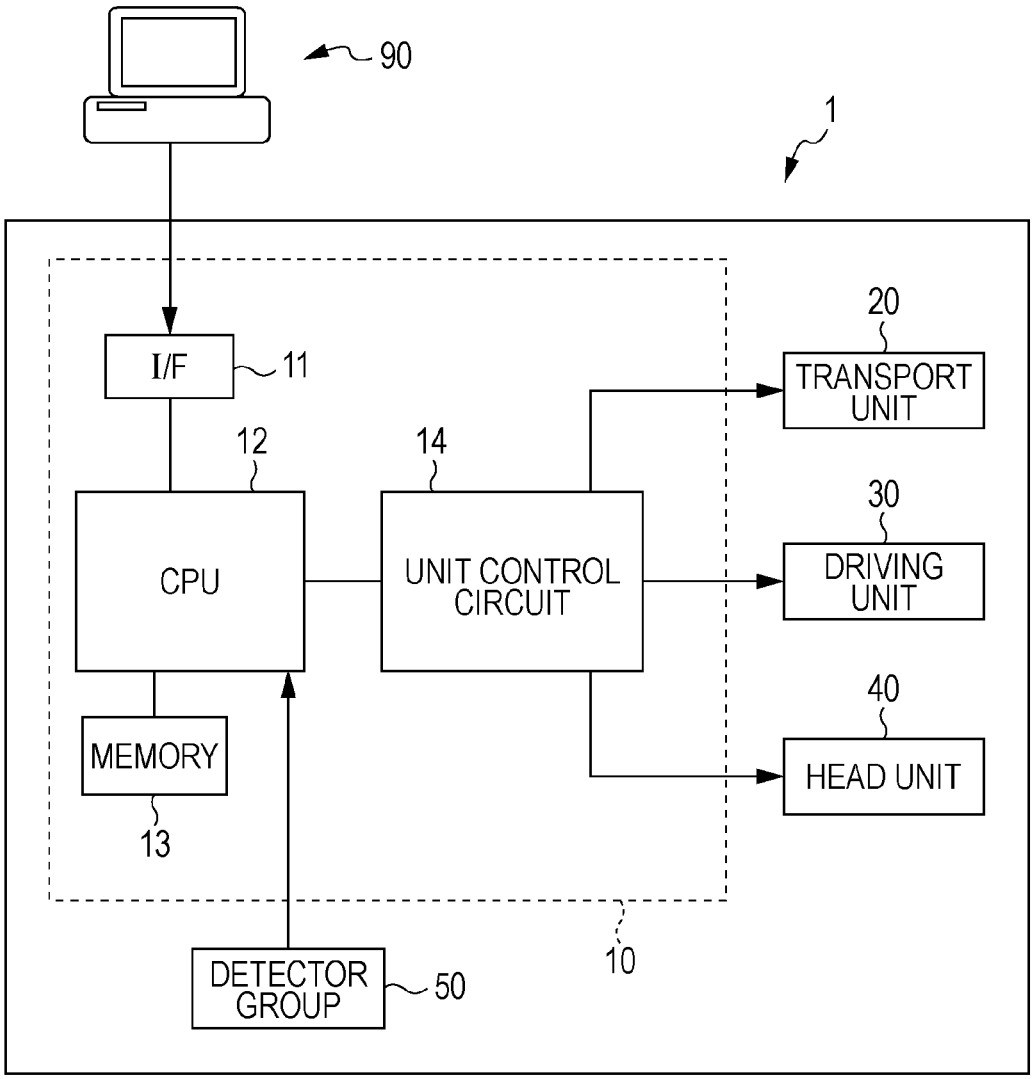
FIG. 1 is a block diagram showing overall configuration of a printer.
Figure 2A:
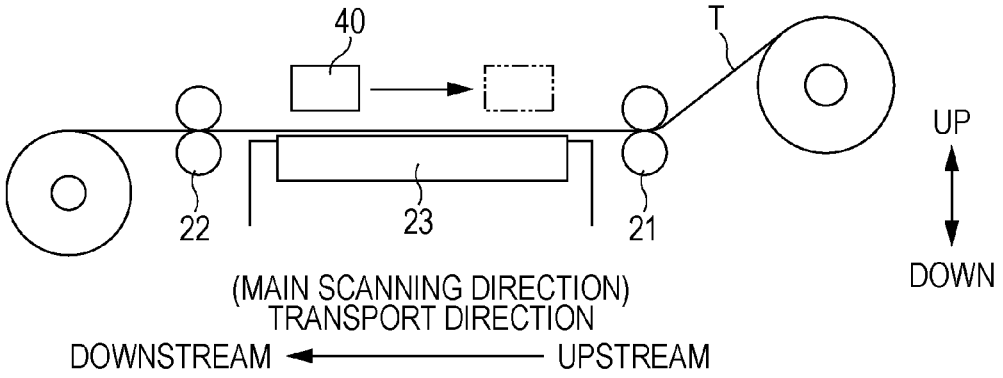
FIG. 2A is a schematic cross-sectional view of the printer.
Figure 2B:
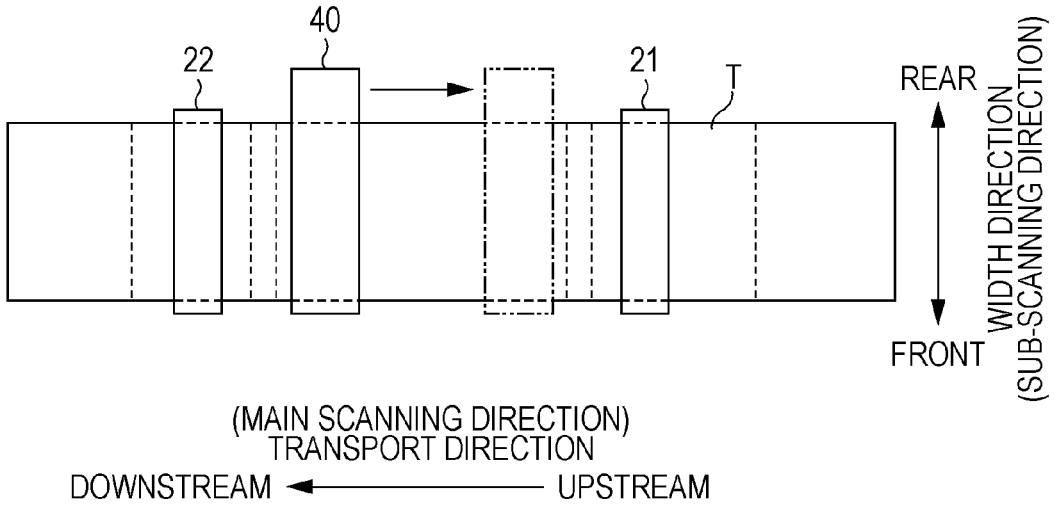
FIG. 2B is a schematic top view of the printer.
Figure 3:
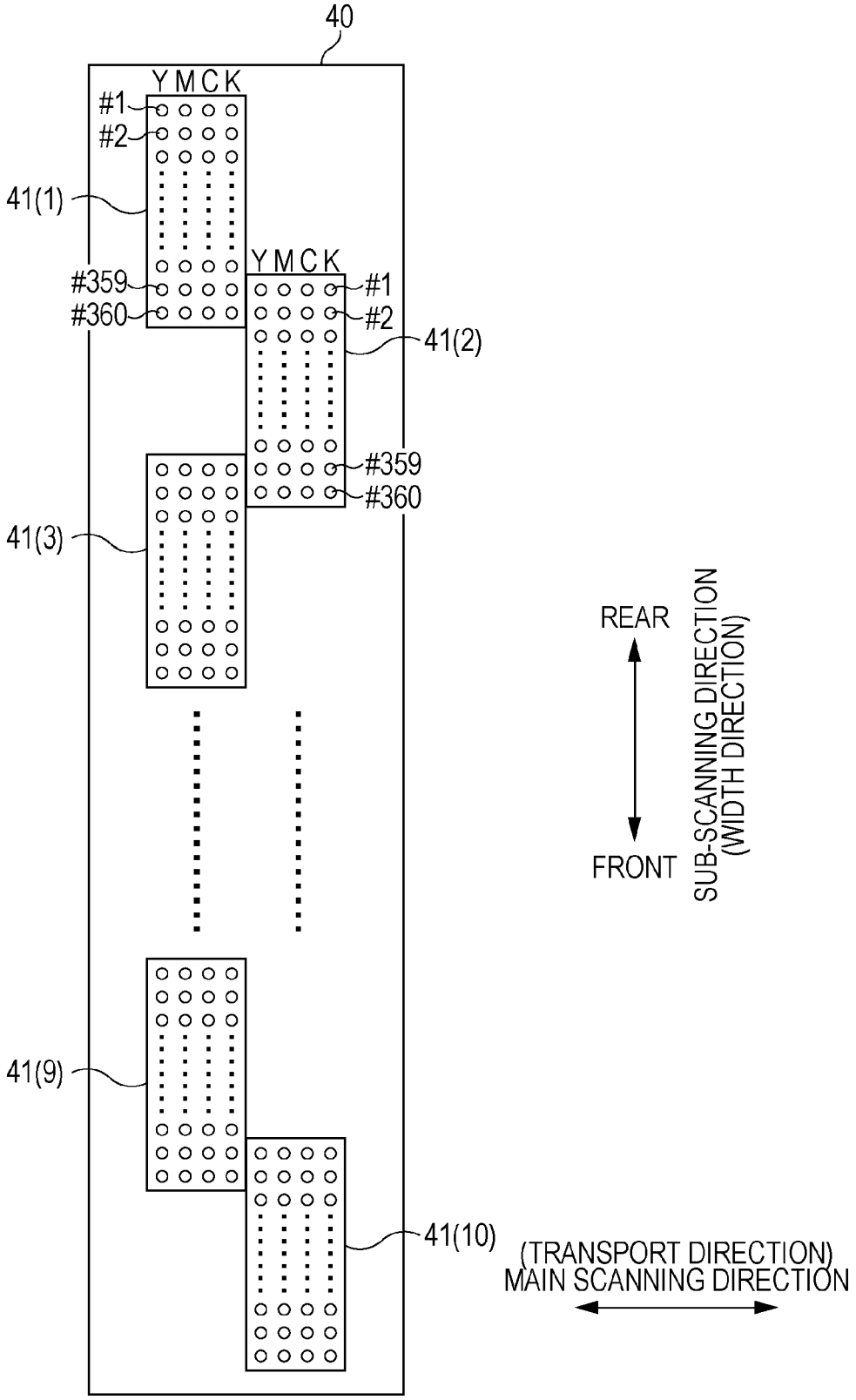
FIG. 3 is a schematic view showing a nozzle arrangement of the bottom surface of a head unit.

FIG. 1 is a block diagram showing the overall configuration of a printer 1. FIG. 2A is a schematic cross-sectional view of the printer 1, and FIG. 2B is a schematic top view of the printer 1. FIG. 3 is a schematic view showing a nozzle arrangement of the bottom surface of a head unit 40.

As shown in FIG. 2A, the printer 1 prints unit images to be used by being cut out later, for example, seal-like printouts to be attached onto a film wrapping for fresh food, on a strip-like print tape T as an example of a print medium (which is also simply referred to as a "medium" hereinafter) by means of an ink jet method. The print tape T is rolled paper (continuous paper) with release paper, and the images configuring the printout are continuously printed in the direction in which the print tape T continues.

As shown in FIG. 1, when the printer 1 receives the print data, a controller 10 as an example of a control portion controls each unit (a transport unit 20, a driving unit 30, and the head unit 40), thereby forming images on the print tape T.

A detector group 50 monitors the internal state of the printer 1, and the controller 10 controls each unit based on detection results obtained by the detector group 50.

The transport unit 20 transports the print tape T from the upstream side to the downstream side in the direction (which will be referred to as "transport direction" hereinafter) in which the print tape T continues. As shown in FIG. 2A, the transport unit 20 includes a transport roller 21, a feeding roller 22, a hot platen 23, and the like. The transport roller 21 transports the roll-like print tape T that has not been printed to the hot platen 23 as a printing area. The hot platen 23 includes a built-in heater (not shown) and heats the medium on the printing area, thereby promoting drying of a medium having an image printed thereon. In the printing area, the hot platen 23 vacuum-sucks the print tape T from below the print tape T, thereby holding (supporting) the print tape T. The feeding roller 22 transports the print tape T in which printing has been completed from the printing area. The print tape T transported from the printing area is wound in a roll shape by a winding mechanism.

The driving unit 30 is a movement mechanism that moves a print head (head unit 40) relative to the print medium (print tape T) stopping in the printing area while causing the print head to discharge a specific ink. Preferably, this movement mechanism alternatively performs scanning for moving the head unit 40 in a predetermined direction and an operation of moving the head unit 40 relative to the print medium in a direction crossing the predetermined direction. Examples of the predetermined direction include a main scanning direction corresponding to the transport direction, and examples of the direction crossing the predetermined direction include a sub-scanning direction corresponding to the width direction of the print tape T. As a preferable embodiment of the movement mechanism, the driving unit 30 is configured with an X movement table that moves the head unit 40 in the main scanning direction, a Y movement table that moves the X movement table holding the head unit 40 in the sub-scanning direction, and a motor that moves these tables (not shown).

The head unit 40 discharges the specific ink while moving relative to the print tape T stopping in the printing area, thereby forming dot columns (raster lines) in the print tape T. In the relative movement described above, the head unit 40 preferably moves relative to the print tape T stopping in the printing area along a predetermined direction (for example, main scanning direction). For example, the head unit 40 includes ten heads 41, and these ten heads 41 are arranged while lining up in a zigzag manner in the width direction (sub-scanning direction). In addition, the ten heads are arranged such that the specific ink can be discharged over the entire width of the print tape T whenever the head unit 40 moves once in the main scanning direction, in other words, such that the width of the head unit 40 in the sub-scanning direction is larger than the width of the print tape T.

As shown in FIG. 3, in the bottom surface of each head 41, a nozzle column Y discharging a yellow ink, a nozzle column M discharging a magenta ink, a nozzle column C discharging a cyan ink, and a nozzle column K discharging a black ink are formed. In each nozzle column, 360 nozzles line up in the width direction at a constant interval (360 dpi). To describe a head 41(1) and a head 41(2) shown in FIG. 3 for example, among these two heads neighboring in the width direction, two foremost nozzles #359 and #360 of the head 41(1) at the rear side, and rearmost nozzles #1 and #2 of the head 41(2) at the front side are positioned in the same line. That is, these nozzles overlap each other.

In the embodiment, the sub-scanning direction corresponds to a first direction, and the main scanning direction corresponds to a second direction.

Printing Operation

1. Movement Pattern of Head Unit 40 During Printing

The recording method of the embodiment performs printing by alternatively performing an operation (step) of forming an image on a print medium positioned in a printing area by discharging a specific ink and a transport operation (transport step) of transporting the print medium. Accordingly, during printing, the print medium (print tape T) is not transported but held in the hot platen 23 positioned in the printing area.

The specific ink and the print medium will be described later.

FIGS. 4A to 4I are schematic views for illustrating the movement pattern of the head unit 40 during printing. The printer 1 performs a plurality of times (four times in the drawing) of scanning for moving the print head (head unit 40) relative to the print medium (print tape T) stopping in the printing area in a predetermined direction (main scanning direction in the drawing) while causing the print head to discharge the specific ink, thereby forming each dot column (raster line). In this manner, an image is formed.

Herein, in the scanning in the operation of forming an image, the print head preferably moves relative to the print medium stopping in the printing area along a predetermined direction while discharging the specific ink.

In addition, in the forming of an image, the scanning for moving the head unit 40 in the predetermined direction, and the operation of moving the head unit 40 relative to the print medium in a direction crossing the predetermined direction are preferably performed alternatively. In this case, since recording can be performed with a printing resolution equal to or higher than the resolution of nozzles mounted on the head unit 40, high image quality can be realized.

In the operation (step) of forming an image, energy is supplied to the specific ink discharged to the print medium, whereby the specific ink is fixed to the print medium. As the energy source, energy supplying heat is effective in respect that volatility of solvents and the like in the ink is promoted and that a fixing resin in the ink is sufficiently promoted to become a covering. As the energy source, forced air heating, radiation heating, conduction heating, high-frequency drying, microwave drying, and the like are preferable, and other known heaters may also be used. In addition, by adding a drying step, a sufficient fixing property and abrasion resistance can be obtained after drying.

Hereinafter, the movement pattern of the head unit 40 during printing will be described in more detail.

Figure 4A:
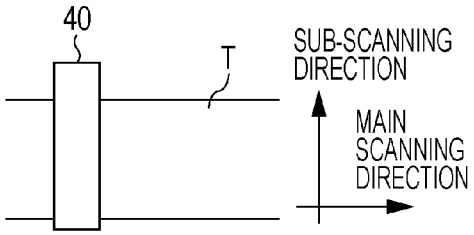
FIGS. 4A to 4I are schematic views for illustrating the movement pattern of the head unit during printing.
Figure 4B:
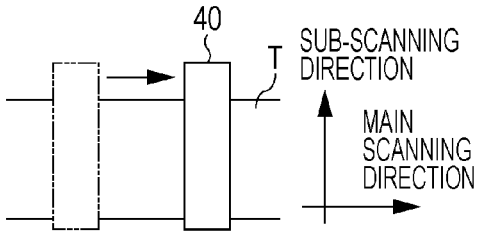
Figure 4C:
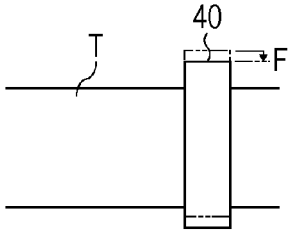
Figure 4D:
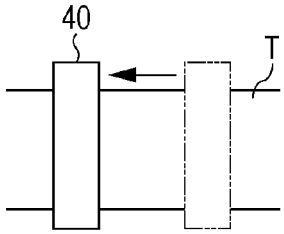
Figure 4E:
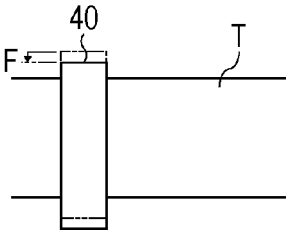
Figure 4F:
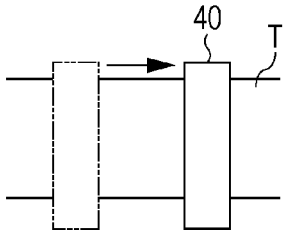
Figure 4G:
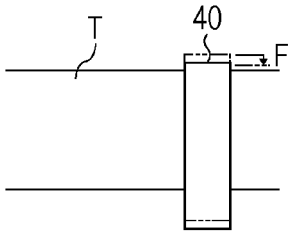
Figure 4H:
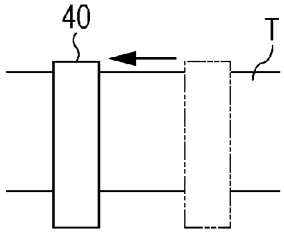
Figure 4I:
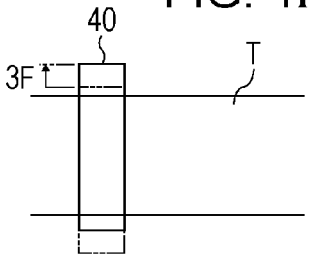

The head unit 40 before printing stands by while stopping at a home position (position shown in FIG. 4A). During printing, first, the head unit 40 moves and scans from the downstream side to the upstream side along the main scanning direction which is the predetermined direction described above, due to the driving unit 30 (FIG. 4B). During this movement and scanning (pass 1), the specific ink is discharged from each nozzle of the head unit 40 over the entire width of the print tape T, whereby a dot column of pass 1 is formed in the print tape T. The head unit 40 having moved in the main scanning direction moves from the rear side to the front side along the sub-scanning direction which is the direction crossing the predetermined direction, due to the driving unit 30 (FIG. 4C). Subsequently, while the head unit 40 moves and scans (pass 2) again from the upstream side to the downstream side along the main scanning direction (FIG. 4D), the specific ink is discharged from the nozzle over the entire width of the print tape T, thereby forming a dot column of pass 2. In this manner, the scanning for moving the head unit 40 in the predetermined direction (main scanning direction), and an operation of moving the head unit 40 in the direction (sub-scanning direction) crossing the predetermined direction are alternatively performed.

In the present specification, "pass" refers to an event in which the head unit 40 relatively moves once in the main scanning direction, and the number after the pass represents the order in which the pass is performed.

As described above, the head unit 40 alternatively performs the movement (FIGS. 4B, 4D, 4F, and 4H) in the main scanning direction of the head unit 40, and the movement (FIGS. 4C, 4E, and 4G) in the sub-scanning direction of the head unit 40 to form dots. Consequently, a plurality of dot columns (raster line group) is formed over the entire width of the print tape T. After completing the fourth movement (pass 4, FIG. 4H) in the main scanning direction, the head unit 40 moves to the rear side in the sub-scanning direction (FIG. 41) and is positioned at the home position shown in FIG. 4A. In this manner, a series of movements of the head unit 40 during printing is completed.

2. Relationship Between Total Sub-scanning Amount of Head Unit and Width of Head Unit During Printing The printer 1 used in the embodiment employs a configuration in which the specific ink is discharged over the entire width of the print tape T during movement and scanning four times (pass 1 to pass 4) in the main scanning direction. This is due to a fact that the resolution of an image (for example, the resolution in sub-scanning direction is 720 dpi) is finer than the nozzle pitch (360 dpi), and is for forming dot columns at intervals finer than the nozzle pitch by moving the head unit 40 in the sub-scanning direction by a 720 dpi unit.

In other words, the print head (head unit 40) includes nozzle columns in which a plurality of nozzles with a predetermined nozzle density (nozzle pitch) line up in a direction (for example, sub-scanning direction) crossing a predetermined direction. In addition, in one step of forming an image, printing is performed with a printing resolution of a direction (for example, sub-scanning direction) crossing a predetermined direction, which is higher than the nozzle density (nozzle pitch) of the head unit 40. The "one step of forming an image" specifically refers to forming an image by one printing operation.

The printing resolution is preferably 360 dpi×360 dpi to 1440 dpi×1440 dpi if represented by "resolution of a predetermined direction×resolution of a direction crossing the predetermined direction". If the printing resolution is in this range, it is possible to print high-quality printouts at a high speed.

The print head includes nozzle columns in which a plurality of nozzles line up in a direction crossing the predetermined direction. Moreover, the length in the direction crossing the predetermined direction of the nozzle column is preferably longer than the length in the direction crossing the predetermined direction of the print medium positioned in the printing area.

In this case, the following effects are obtained. Over the entire printing area of the print medium, dots can be formed by one main scanning. Though one main scanning does not form dots for all pixels (dots are formed for a portion of pixels selected from of all pixels for which dots are supposed to be formed finally) since an interlace recording method or an overlap recording method is implemented, the dots can be evenly formed in the entire area. Therefore, as the ink is attached to the print medium and dried, the print medium is curled, and this curling occurs over the entire printing area due to the first main scanning when expansion and contraction occur. The curling does not only occur in a portion of the printing area. Even if the main scanning is repeated, the entire printing area evenly expands and contracts. In this case, since misalignment of the landing position of dots evenly occurs throughout the entire image, the misalignment is not easily noticed as image disturbance.

On the other hand, when a head shorter than paper width is used, one main scanning can form dots only in a portion of area in the paper width direction (direction crossing the main scanning direction), and at this time, curling or expansion and contraction occurs only in the portion of the area in which dots have been formed. In the second main scanning, dots are also formed in the area in which dots have not been formed by the first main scanning performed in the paper width direction. However, in this case, the print medium includes an area in which the contraction and expansion have not occurred and an area in which the contraction and expansion have occurred. Consequently, the misalignment of the landing position of dots occurs with different accuracy depending on the area of the print medium, so image disturbance occurs. Whenever the main scanning is repeated, a portion of the recording area unevenly expands and contracts, so image disturbance occurs.

Regarding the expansion and contraction of the print medium, if the medium is paper, it is generally said that paper expands when an ink is attached thereto and then contracts (contracts more than the original state) as the ink is dried. In the case of the embodiment, the print medium is not limited to paper but also includes films, coating paper, and the like (non-absorptive media). However, it is considered that though absorptive media are greatly affected by the expansion and contraction, non-absorptive media are also affected.

In a serial method, dots can be formed in the entire paper width direction by one main scanning. However, in the transport direction of paper, dots with a length (several centimeters) of one head are formed, and printing is performed bit by bit whenever the main scanning is carried out. Accordingly, this leads to a result similar to a case in which a short head is used in a lateral method. Moreover, since paper is transported whenever the main scanning is performed in the serial method, transport accuracy of paper in transporting paper having expanded and contracted decreases. In the lateral method, paper is not transported while an image is formed, and in this respect, the case of using a short head in the lateral method is better.

A case in which the lateral method is used and the head is shorter than a paper width can be mentioned as a preferable case.

3. Printing Process of the Embodiment

Various operations of the printer 1 that are performed when the printing process is executed are mainly realized by a controller 10. Particularly, in the embodiment, the operations are realized when CPU 12 processes a program stored in a memory 13. The program is configured with codes for performing various operations described below.

Figure 5:
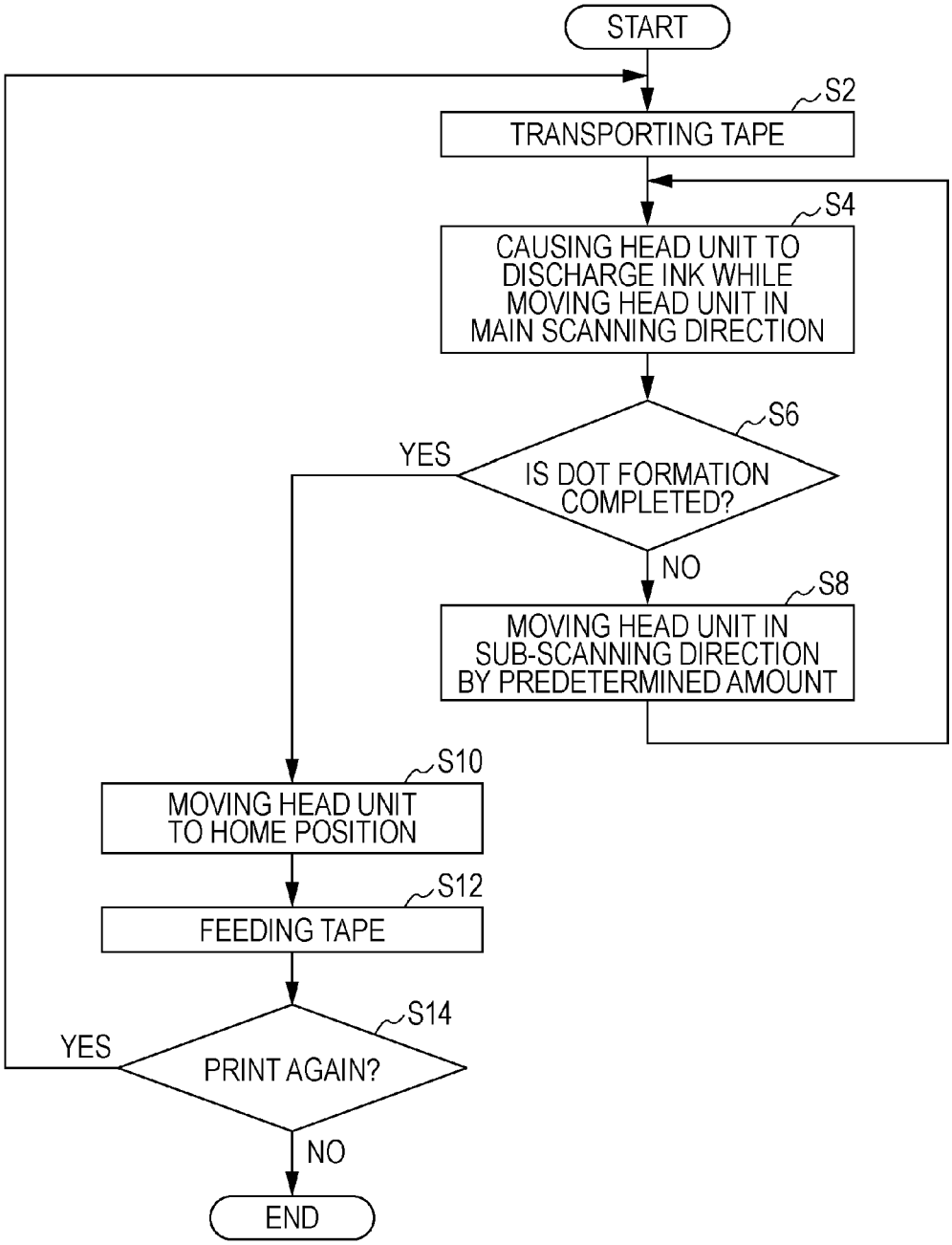
FIG. 5 is a flowchart for illustrating the present printing process.

FIG. 5 is a flowchart for illustrating the present printing process. The flowchart shown in FIG. 5 starts from when the controller 10 receives print data from a computer 90 (FIG. 1) through an interface 11.

In the printing process, first, the controller 10 transports the print tape T as an example of a print medium to the printing area by a transport unit 20 (step S2) (transporting). That is, the transport roller 21 transports the print tape T that has not been printed to the hot platen 23 as the printing area.

Next, while moving the head unit 40 relative to (herein, in the main scanning direction) the driving unit 30 (FIG. 4B), the controller 10 causes the nozzle of the head unit 40 (print head) to discharge the specific ink (step S4). That is, the controller 10 forms a dot column of the pass 1 in the print tape T (print medium) held and stopped in the hot platen 23. An image (printout) is formed by a plurality of times of scanning (4 passes herein). Accordingly, when the dot column of the pass 1 is formed, the controller 10 moves the head unit 40 relative to (herein, in the sub-scanning direction) the driving unit 30 by a constant sub-scanning amount (FIG. 4C) (step S6: No, followed by step S8).

Herein, the platen temperature in the hot platen 23 is preferably 30° C. to 80° C., and more preferably 40° C. to 70° C., since drying of ink is speeded up, and printing deterioration such as bleeding and aggregation variation can be suppressed in this temperature range. The temperature can be appropriately determined according to the heat resistance of the print medium.

Until the dot formation process is completed, the controller 10 alternatively performs dot column formation (FIGS. 4D, 4F, and 4H) accompanying the relative movement of the head unit 40 (herein, movement in the main scanning direction), and the relative movement (herein, movement in the sub-scanning direction) of the head unit 40 (FIGS. 4E and 4G) (steps S4 to S8). Although not shown in the drawing, at a point of time when the dot formation process is completed, energy is supplied to the specific ink discharged to the print tape T (print medium), whereby the specific ink is fixed to the print tape T (print medium) (forming an image hereinbefore).

Printing is performed by alternatively performing the above-described transporting and forming an image.

In the embodiment, a so-called overlap printing may be performed.

Herein, the overlap printing in the embodiment will be described. The overlap printing refers to a printing method that forms one dot column (raster line) by two or more nozzles. Specifically, one nozzle forms a dot column intermittently at an interval of several dots, and then the other nozzle forms the dot column so as to complement the intermittent dot column that has already been formed.

Figure 6:
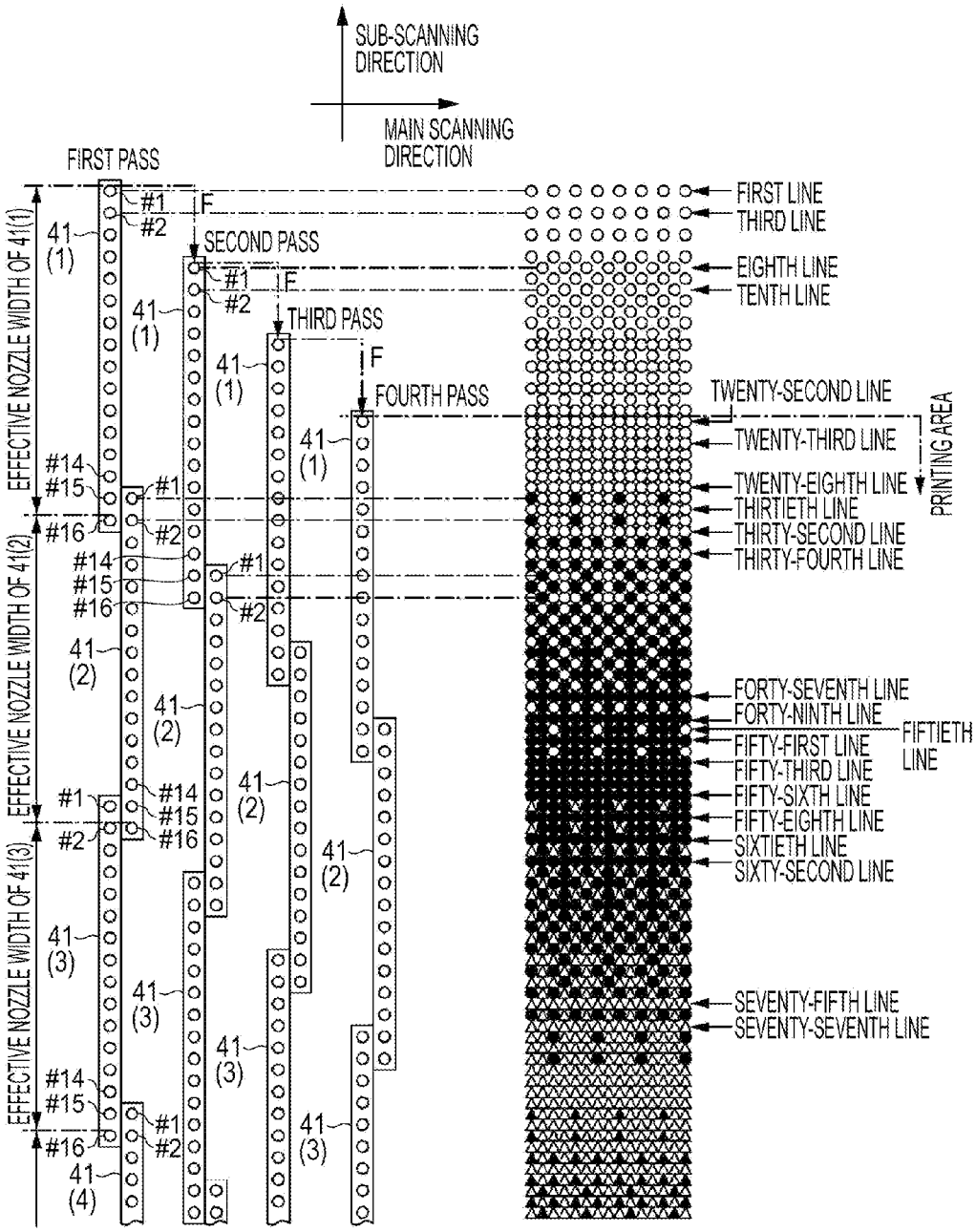
FIG. 6 is a view for illustrating overlap printing in an embodiment of the invention.
Figure 7:
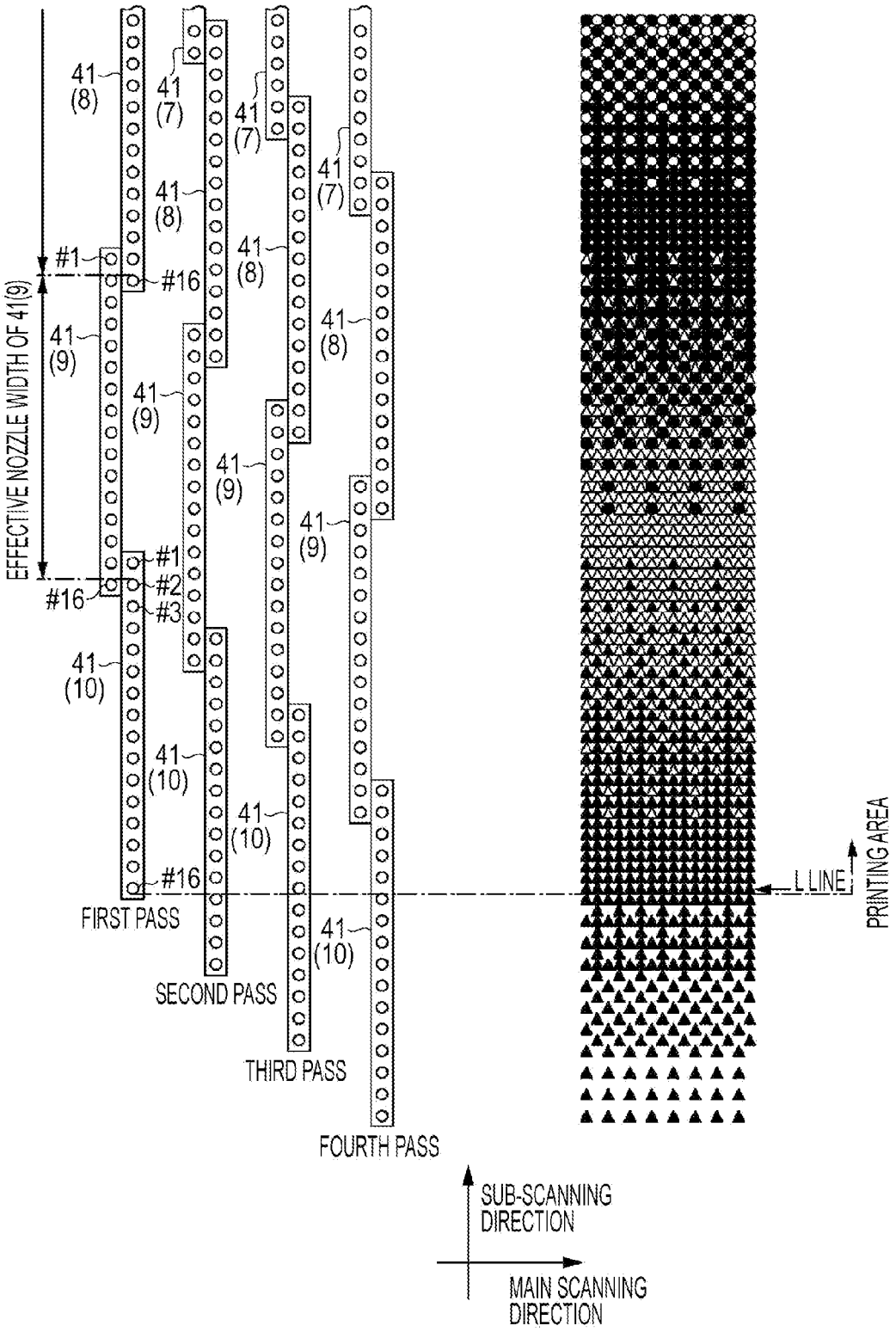
FIG. 7 is a view for illustrating overlap printing in an embodiment of the invention.

FIGS. 6 and 7 are views for illustrating the overlap printing in the embodiment. Here, to simplify the description, only a nozzle column C is shown among four nozzle columns (a nozzle column Y, a nozzle column M, a nozzle column C, and a nozzle column K) of each head 41, and the number of nozzles of each head 41 is reduced to 16. Therefore, FIG. 6 shows the positions in pass 1 to pass 4 of the nozzle column C of the heads (the head 41(1), the head 41(2), and the like) at the rear side in the sub-scanning direction among ten heads 41, and the state of dot formation. In addition, FIG. 7 shows the positions in pass 1 to pass 4 of the nozzle column C of the heads (the head (10), the head 41(9), and the like) at the front side in the sub-scanning direction, and the state of dot formation. Moreover, in FIGS. 6 and 7, dots formed by nozzles of the heads 41(1) and 41(7) are represented by white circles (○), dots formed by nozzles of the heads 41(2) and 41(8) are represented by black circles (●), dots formed by nozzles of the heads 41(3) and 41(9) are represented by white triangles (Δ), and dots formed by nozzles of the heads 41(4) and 41(10) are represented by black triangles (▲).

In the pass 1 to pass 4, dots are formed in pixels of the printing area by the respective nozzles of the nozzle column C. The "pixels" herein refers to square cells that are hypothetically set on the print tape T to regulate the position for forming dots. In order to specifically describe the pixels, pixels lining up in the main scanning direction are represented by "lines", and pixels lining up in the sub-scanning direction are represented by "columns". In addition, the pixels shown in FIGS. 6 and 7 line up at an interval of 720 dpi in both the main scanning direction and sub-scanning direction.

First, in the pass 1, the specific ink is discharged from nozzles of each head 41. In addition, dots columns are formed in the pixels of odd lines (the first, third, fifth . . . lines) and odd columns (the first, third, fifth . . . columns) shown in FIG. 6. For example, the specific ink is discharged from a nozzle #1 of the head 41(1), thereby forming dots in the pixels of odd columns of the first line. Similarly, the specific ink is discharged from a nozzle #2 of the head 41(1), thereby forming dots in the pixels of odd columns of the third line. In this manner, the respective nozzles form dots in every other pixel in the main scanning direction, in the respective lines corresponding to the respective positions.

The method in which the overlapped nozzles of two heads (herein, the head 41(1) and head 41(2) are described for example) neighboring in the width direction discharge the specific ink is different from the method in which the non-overlapped nozzles (for example, the nozzle #1 of the head 41(1)) discharge the specific ink. That is, in the pass 1, nozzles #15 and #16 of the head 41(1) at the rear side in the width direction form dot columns in the pixels of the third, seventh, eleventh . . . columns, and the nozzles #1 and #2 of the head 41(2) at the front side form dot columns in the pixels of the first, fifth, ninth . . . columns. In this manner, the nozzles of the two neighboring heads 41 alternatively discharge the specific ink, thereby forming the dot columns in the pixels of odd columns.

After the completion of the pass 1, the head unit 40 moves from the rear side to the front side in the sub-scanning direction by a predetermined sub-scanning amount F (specifically, 7/720 dpi), as the first movement in the sub-scanning direction in printing.

In the pass 2 after the movement of the head unit 40, dot columns are formed in the pixels of even lines (the eighth, tenth, twelfth . . . lines) and even columns (the second, fourth, sixth . . . columns). For example, the specific ink is discharged from the nozzle #1 of the head 41(1), thereby forming dots in the pixels of even columns of the eighth line. Similarly, the specific ink is discharged from the nozzle #2 of the head 41(1), thereby forming dots in the pixels of even columns of the tenth line. In the second pass, among neighboring heads, the nozzles #15 and #16 of the head 41(1) at the rear side in the width direction form dot columns in the pixels of the fourth, eighth, twelfth . . . columns, and the nozzles #1 and #2 of the head 41(2) at the front side form dot columns in the pixels of the second, sixth, tenth . . . columns. That is, similarly to the first pass, the nozzles of two neighboring heads 41 alternatively discharge the specific ink, thereby forming dots in the pixels of even columns (the same formation pattern is also applied to the third and fourth passes described later).

After the pass 2 is completed, the head unit 40 moves by a predetermined sub-scanning amount F (7/720 dpi), as the second movement in the sub-scanning direction.

Similarly, in a pass 3, dot columns are formed in the pixels of odd lines (the fifteenth, seventeenth, nineteenth . . . lines) and even columns (the second, fourth, sixth . . . columns). As a result, by the passes 1 and 3, a dot column of the twenty-third line is completed, for example.

After the pass 3 is completed, the head unit 40 moves by the sub-scanning amount F (7/720 dpi) which is the same size as the first and second sub-scanning amounts, as the third movement in the sub-scanning direction.

In a pass 4, dot columns are formed in the pixels of even lines (the twenty-second, twenty-fourth, twenty-sixth . . . lines) and odd columns (the first, third, fifth . . . columns). As a result, by the passes 2 and 4, a dot column of the twenty-second line is completed, for example. In this manner, in the overlap printing of the embodiment, one dot column is formed by two different nozzles.

So far, the overlap printing in the embodiment has been described. The description of the printing process will be continued by returning to the flowchart shown in FIG. 5. When the dot formation process is completed by the dot column formation of the pass 4 (step S6: Yes), that is, a printout (image) is printed on the print tape T, the controller 10 moves the head unit 40 to the driving unit 30 in the sub-scanning direction (FIG. 4I), thereby positioning the head unit 40 in the home position (step S10).

Thereafter, the controller 10 feeds (transports) the print tape T in which dots have been formed (print tape T in which printing has been completed) from the printing area, by the transport unit 20 (step S12). That is, the feeding roller 22 feeds (transports) the print tape T in which printing has been completed from the printing area.

When there are more print data to be printed (step S14: Yes), the controller 10 repeats the above-described operations (steps S2 to S12), thereby printing the data on the print tape T. On the other hand, when there are no print data (step S14: No), the controller 10 ends the printing process.

FIRST MODIFIED EXAMPLE

Figure 8:
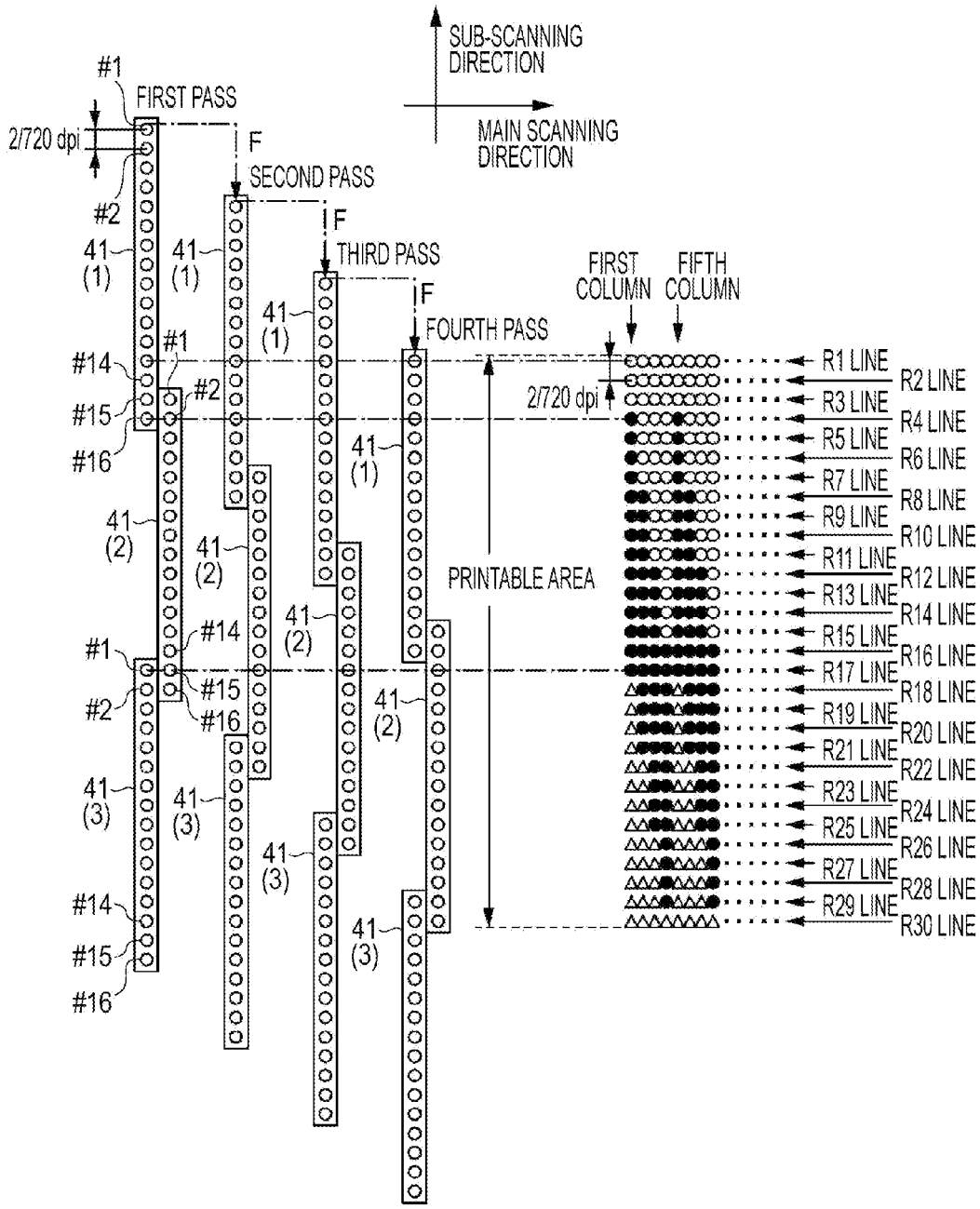
FIG. 8 is a view for illustrating overlap printing in a second modified example.

Next, the overlap printing in a first modified example will be described. FIG. 8 is a view for illustrating the overlap printing in the first modified example.

In the first modified example, one raster line is completed by four passes as shown in FIG. 8 (overlap printing). That is, during the four passes, the specific ink is discharged from each head, whereby one raster line is completed. Specifically, dots of the first and fifth columns are formed by the first pass, dots of the second and sixth columns are formed by the second pass, dots of the third and sixth columns are formed by the third pass, and dots of the fourth and eighth columns are formed by the fourth pass. In FIG. 8, dots to the eighth columns are shown, but dots of more columns are formed actually.

The head unit 40 of the embodiment is the same as the head unit 40 (FIG. 3) of the above-described embodiment. That is, there are overlapped nozzles in two neighboring heads 41. The nozzle pitch of each nozzle is 1/360 dpi.

While the interval in the raster lines of the above-described embodiment is 1/720 dpi (see FIG. 6), the interval in the raster lines shown in FIG. 8 is 2/720 dpi (=1/360 dpi). That is, the interval is the same size as the nozzle pitch. Therefore, in a second modified example, unlike the embodiment described above and the first modified example, interlace printing is not performed. The interlace printing refers to a printing method in which a raster line that is not formed is interposed between raster lines formed by one pass, as shown in FIG. 6.

In FIG. 8, only the nozzle column C is shown, and the number of nozzles of each head 41 is 16, similarly to FIG. 6. Herein, for convenience of description, it is supposed that the head unit 40 includes three heads 42(1) to 42(3) in the description. In addition, dots formed by the nozzles of the head 41(1) are represented by white circles (○), dots formed by the nozzles of the head 41(2) are represented by black circles (●), and dots formed by the nozzles of the head 41(3) are represented by white triangles (Δ).

The effective nozzles of each head 41 shown in FIG. 8 are configured in the following manner similarly to the embodiment described above. The head 41(1) has 15 effective nozzles including nozzles #1 to #15, and the effective nozzle width thereof is 30/720 dpi. The head 41(2) has 14 effective nozzles including nozzles #2 to #15, and the effective nozzle width thereof is 28/720 dpi. The head 41(3) has 15 effective nozzles including nozzles #2 to #16, and the effective nozzle width thereof is 30/720 dpi.

In the first modified example, the sub-scanning amount F of one pass of the head unit 40 is 8/720 dpi, and a total sub-scanning amount 3F of 4 passes is 24/720 dpi. Similarly, in the second modified example, the total sub-scanning amount 3F (24/720 dpi) is set to be smaller than the small effective nozzle width (28/720 dpi) between two effective nozzle widths. Accordingly, similarly to the embodiment described above, it is possible to suppress the increase in the width in the sub-scanning direction of the head unit 40.

Herein, which nozzles of the heads 41 form the respective raster lines in the printing area will be reviewed. The raster lines in the printing area in the embodiment refer to the raster lines from an R1 line to an R30 line as shown in FIG. 8.

First, the raster lines from the R1 line to an R3 line are formed solely by the nozzles of the head 41(1). The raster lines from an R4 line to an R15 line are formed by the nozzles of the heads 41(1) and 41(2). The raster lines of an R16 line and an R17 line are formed solely by the nozzles of the head 41(2). The raster lines from an R18 line to an R29 line are formed by the nozzles of the heads 41(2) and 41(3). The raster line of the R30 line is formed solely by the nozzle of the head 41(3).

To review the raster lines in the range of the effective nozzle width (28/720 dpi) described above, the number of raster lines that only the nozzles of a single head 41 form by discharging the specific ink is twelve including the R14 line to R15 line, and the number of raster lines that the nozzles of two heads 41 form by discharging the specific ink is two including the R16 line and R17 line.

Herein, raster lines from the R4 line to R27 line will be described for example.

As described above, the number of raster lines that only the nozzles of a single head 41 form by discharging the specific ink is smaller than the number of raster lines that the nozzles of two or more heads 41 form by discharging the specific ink. Consequently, similarly to the embodiment described above, even if there are raster lines formed solely by the nozzles of a single head 41, the number of raster lines showing density variation can be reduced, and accordingly, the density variation can be suppressed from being noticeable.

In the above description, the sub-scanning amount F per pass during four passes is set to the same size of 8/720 dpi, but the sub-scanning amount per pass may be set differently. In addition, in the above description, dots of the first column (fifth column) are formed by the first pass, dots of the second column (sixth column) are formed by the second pass, dots of the third column (seventh column) are formed by the third pass, and dots of the fourth column (eighth column) are formed by the fourth pass. However, the invention is not limited thereto, and at least dots of neighboring columns may be formed by different passes.

In the above description, one raster line is formed by 4 passes, but the invention is not limited thereto. One raster line may be formed by at least 2 passes, that is, formed by 2 or more integer number of times of passes. For example, one raster line may be formed by 3 passes (this point is applied to the embodiment described above in the same manner).

OTHER MODIFIED EXAMPLES

So far, the apparatus used in the recording method of the invention has been described based on the embodiment and modified examples described above. However, the embodiment and modified examples described above are just for facilitating understanding of the invention, and do not limit the invention. Needless to say, the invention can be modified and refined within a range that does not depart from the scope of the invention, and the invention also includes the equivalents thereof.

In the embodiment and modified examples described above, the head unit 40 moves 4 times in the main scanning direction and 3 times in the sub-scanning direction while the print tape T stops, whereby raster lines are formed (FIGS. 6 and 7). However, the invention is not limited thereto. For example, the head unit 40 may move only in the main scanning direction, and the print tape T may move in the sub-scanning direction, whereby the raster lines may be formed. Alternatively, the head unit 40 may not move, and the print tape T may move in the main scanning direction and sub-scanning direction, whereby the raster lines may be formed. That is, the head unit 40 may relatively move in the main scanning direction and sub-scanning direction with respect to the print tape T, whereby the raster lines may be formed.

In the embodiment shown in FIGS. 6 and 7, so-called interlace printing is performed in which there are raster lines that are not formed by one pass but by other passes, between raster lines that are formed by the one pass. Moreover, in the embodiment, the overlap printing is performed in which dots of one raster line are formed by two or more nozzles. In the first modified example, the overlap printing is performed without the interlace printing. However, the invention is not limited thereto, and the interlace printing may be performed without the overlap printing (dots of one raster line may be formed by one nozzle). That is, as the recording method used in the invention, at least one of the interlace printing and overlap printing may be performed.

In addition, the drying mechanism in not limited to a mechanism of heating the platen as long as the mechanism can dry the ink in the print medium stopping in the platen, and the mechanism may directly supply energy such as heat to the print medium. Moreover, the mechanism is not limited to a mechanism using heat energy to dry the print medium. The mechanism may blow air or emit active energy rays such as electromagnetic radiation.

Based on the embodiment of the invention described above, the recording method of the above-described embodiment or the like will be further described. This recording method is a so-called lateral method that forms an image by one printing operation by means of performing a plurality of times of scanning with a head on a print medium stopping in the platen provided with a drying mechanism, as described above. In this lateral recording method, a printer is used which forms an image by performing a plurality of times of scanning with a head on a print medium stopping in the platen provided with a drying mechanism as described above, but this printer can print greater amounts at higher speed, compared to a so-called serial printer. This is because an ink-drying time of the printout printed by this printer is much shorter than that of the serial printer.

This printer having characteristics such as mass-printing and high-speed printing is in great demand particularly for the use of label printing, for the following reason. When used by being attached to food packs and the like, the labels are frequently stained and scraped. However, since the ink-drying time of labels printed by this printer is very short, the labels are very resistant to staining and scraping.

As the print medium used for the label described above, paper and films of polypropylene (PP), polyethylene terephthalate (PET), polyvinyl chloride (vinyl chloride), and the like are frequently used, in view of costs. The paper and films of PP and PET are used for food packs and the like, and the vinyl chloride film is used for car wrapping, building material signs, and the like. As an ink containing solvents suitable for the paper and films, the ink described later can be used. As a result, the present inventors found that by using the specific ink in the above described printer, it is possible to rapidly produce a large amount of excellent labels at low costs.

As described so far, according to the embodiment, it is possible to provide a recording method that is excellent in the fixing property, tackiness, and landing accuracy.

Ink

An embodiment of the invention relates to an ink used for the recording method of the embodiment described above, that is, to a specific ink. The specific ink contains 60% by mass or more of one or more kinds of organic solvent that have a boiling point of 120° C. to 240° C. and are selected from a group consisting of glycol ether-based solvents and non-protonic polar solvents in the ink composition. By using such a specific ink, that is, a specific non-aqueous ink that substantially does not contain water for the recording method of the printing method of the embodiment, the fixing property, tackiness, and landing accuracy can be improved. Hereinafter, this specific ink will be described in detail.

Organic Solvent

The specific ink in the embodiment contains organic solvents. A boiling point of the organic solvent is 120° C. to 240° C., and preferably 120° C. to 230° C. If the boiling point is in this range, it is possible to perform high-speed printing while suppressing bleeding and aggregation variation by increasing ink-drying speed, and to secure discharge stability of the ink.

The organic solvents are one or more solvents selected from a group consisting of glycol ether-based solvents and non-protonic polar solvents.

The glycol ether-based solvent is not particularly limited as long as the boiling point thereof is in the above-described range. Examples of the glycol ether-based solvent include alkylene glycol monoalkyl ethers, alkylene glycol dialkyl ethers, and alkylene glycol monoalkyl ether acetates.

Examples of the alkylene glycol monoalkyl ethers include, but are not limited to, diethylene glycol monoalkyl ether, triethylene glycol monoalkyl ether, and dipropylene glycol monoalkyl ether. Specific examples thereof include, but are not limited to, ethylene glycol monomethyl ether (boiling point of 125° C.), ethylene glycol monoethyl ether (boiling point of 136° C.), ethylene glycol mono-n-butyl ether (boiling point of 170° C.), ethylene glycol mono-tert-butyl ether (boiling point of 153° C.), diethylene glycol monomethyl ether (boiling point of 194° C.), diethylene glycol monoethyl ether (boiling point of 202° C.), diethylene glycol monobutyl ether (boiling point of 230° C.), propylene glycol monomethyl ether (boiling point of 120° C., also referred to as "PGME" hereinbelow), propylene glycol monoethyl ether (boiling point of 132° C.), propylene glycol monobutyl ether (boiling point of 170° C.), dipropylene glycol monomethyl ether (boiling point of 188° C.), dipropylene glycol monopropyl ether (boiling point of 230° C., also referred to as "DPGPE" hereinbelow), ethylene glycol mono-2-ethylhexyl ether (boiling point of 229° C., also referred to as "EHG" hereinbelow), and the like.

Among these, PGME, DPGPE, and EHG are preferable.

Examples of the alkylene glycol dialkyl ethers include, but are not limited to, diethylene glycol dialkyl ether, triethylene glycol dialkyl ether, and dipropylene glycol dialkyl ether. Specific examples thereof include, but are not limited to, ethylene glycol diethyl ether (boiling point of 121° C.), ethylene glycol dibutyl ether (boiling point of 203° C.), diethylene glycol ethylmethyl ether (boiling point of 176° C.), diethylene glycol dimethyl ether (Diglyme, boiling point of 162° C., also referred to as "GL-2" hereinbelow), diethylene glycol diethyl ether (boiling point of 189° C., also referred to as "DEGDEE" hereinbelow), dipropylene glycol dimethyl ether (boiling point of 171° C., also referred to as "DPGDME" hereinbelow), triethylene glycol dimethyl ether (Triglyme, boiling point of 216° C., also referred to as "GL-3" hereinbelow), and the like.

Among these, DEGDEE, DPGDME, and GL-3 are preferable.

Examples of the alkylene glycol monoalkyl ether acetates include, but are not limited to, ethylene glycol monoalkyl ether acetate, propylene glycol monoalkyl acetate, diethylene glycol monoalkyl acetate, and dipropylene glycol monoalkyl acetate. Specific examples thereof include, but are not limited to, ethylene glycol monomethyl ether acetate (boiling point of 145° C.), diethylene glycol monoethyl ether acetate (boiling point of 217° C.), ethylene glycol monoethyl ether acetate (boiling point of 156° C.), ethylene glycol monobutyl ether acetate (boiling point of 217° C., also referred to as "EGBEA" hereinbelow), diethylene glycol monoethyl ether acetate (boiling point of 217° C.), propylene glycol monomethyl ether acetate (boiling point of 146° C., also referred to as "PGMEA" hereinbelow), and the like.

Among these, EGBEA and PGMEA are preferable.

The non-protonic polar solvent is not particularly limited as long as the boiling point thereof is in the above-described range, and examples thereof include lactone-based solvents such as β-propiolactone (boiling point of 155° C.), γ-butyrolactone (boiling point of 203° C., also referred to as "GBL" hereinbelow), γ-valerolactone (boiling point of 207° C.), γ-hexylactone (boiling point of 219° C.), γ-octalactone (boiling point of 234° C.), γ-nonalactone (boiling point of 121° C.), δ-valerolactone (boiling point of 230° C.), δ-octalactone (boiling point of 238° C.), δ-nonalactone (boiling point of 121° C.), δ-decalactone (boiling point of 120° C.), and δ-undecalactone (boiling point of 152° C.), N-methyl-2-pyrrolidone (boiling point of 202° C., also referred to as "NMP"

hereinbelow), hexamethylphosphoric triamide (boiling point of 230° C., HMPA), N-cyclohexylpyrrolidone (boiling point of 154° C., NCP), tetramethylurea (boiling point of 177° C., TCU), 1,3-dimethyl-2-imidazolidinone (boiling point of 225° C., also referred to as "DMI" hereinbelow), N,N-dimethylformamide (boiling point of 153° C., DMF), N,N-dimethylacetoamide (boiling point of 166° C., DMA), tetramethylene sulfoxide (boiling point of 235° C.), dimethyl sulfoxide (boiling point of 189° C., also referred to as "DMSO" hereinbelow), and the like.

Among these solvents, the lactone-based solvent is a compound having a ring structure formed by an ester bond, and examples thereof include γ-lactone having a 5-membered ring structure, δ-lactone having a 6-membered ring structure, ϵ-lactone having a 7-membered ring structure, and the like.

Among these, GBL, NMP, DMI, and DMSO are preferable.

The organic solvents in the embodiment may further contain other organic solvents known in the related art, within a range that does not depart from the object of the invention. As other organic solvents, polar organic solvents are preferable. Specific examples of the polar organic solvents include alcohols such as methanol, ethanol, 1-propanol, 2-propanol, butanol, fluoroalcohol, 1,2-hexanediol, dipropylene glycol, and triethylene glycol; ketones such as acetone, methyl ethyl ketone, and cyclohexanone; carboxylic acid esters such as methyl acetate, ethyl acetate, propyl acetate, butyl acetate, methyl propionate, and ethyl propionate; and ethers such as diethyl ether, dipropyl ether, tetrahydrofuran, and dioxane.

Specific components of the organic solvents may be used alone or in combination of two or more kinds thereof.

The content of the organic solvent is 60% by mass or more, and preferably 70% by mass or more, based on the total amount (100% by mass) of the specific ink. If the content is in this range, the ink shows an excellent labeling property with respect to the print medium, and high-quality images can be printed without aggregation variation regardless of the type of the print medium. In addition, a high fixing property with respect to film type media can be added.

Provided that the evaporation rate of water is 1, a relative evaporation rate of the organic solvent is preferably 1/100 to 1, and more preferably from 1/90 to 1. If the relative evaporation rate is in this range, the ink is suppressed from being dried in the head, the ink can be stably discharged, and excellent landing accuracy can be secured. Moreover, if the solvent is used in combination with the lateral recording method of the invention, it is possible to effectively suppress bleeding and aggregation variation of printouts.

Specific examples of such organic solvents include dipropylene glycol dimethyl ether (DPGDME), diethylene glycol diethyl ether (DEGDEE), γ-butyrolactone (GBL), ethylene glycol mono-2-ethylhexyl ether (EHG), dipropylene glycol monopropyl ether (DPGPE), propylene glycol monomethyl ether (PGME), N-methyl-2-pyrrolidone (NMP), propylene glycol monomethyl ether, propylene glycol methyl ether acetate, triethylene glycol dimethyl ether, ethylene glycol monobutyl ether acetate, and 1,3-dimethyl-2-imidazolidinone.

Coloring Material

The specific ink of the embodiment may further contain coloring materials, and these coloring materials are selected from pigments and dyes.

As the pigments, inorganic and organic pigments can be used without particular limitation.

As the inorganic pigments, carbon black that is produced by known methods such as a contact method, a furnace method, and a thermal method can be used in addition to titanium oxide and iron oxide. As the organic pigments, azo pigments (including azo lake, insoluble azo pigments, condensed azo pigments, chelate azo pigments, and the like), polycyclic pigments (for example, phthalocyanine pigments, perylene pigments, perinone pigments, anthraquinone pigments, quinacridone pigments, dioxazine pigments, thioindigo pigments, isoindolinone pigments, quinophthalone pigments, and the like), dye chelate (for example, basic dye-type chelate, acidic dye-type chelate, and the like), nitro pigments, nitroso pigments, aniline black, and the like can be used.

More specifically, examples of carbon black usable as a black ink include No. 2300, No. 900, MCF88, No. 33, No. 40, No. 45, No. 52, MA7, MA8, MA100, No. 2200B, and the like (manufactured by Mitsubishi Chemical Corporation); Raven 5750, Raven 5250, Raven 5000, Raven 3500, Raven 1255, Raven 700, and the like (manufactured by Carbon Columbia); Regal 400R, Regal 330R, Regal 660R, Mogul L, Monarch 700, Monarch 800, Monarch 880, Monarch 900, Monarch 1000, Monarch 1100, Monarch 1300, Monarch 1400, and the like (manufactured by CABOT JAPAN K. K.); and Color Black FW1, Color Black FW2, Color Black FW2V, Color Black FW18, Color Black FW200, Color Black 5150, Color Black 5160, Color Black 5170, Printex 35, Printex U, Printex V, Printex 140U, Special Black 6, Special Black 5, Special Black 4A, Special Black 4, and the like (manufactured by Degussa).

As white pigments usable as a white ink, for example, inorganic white pigments, organic white pigments, and white hollow resin particles can be used. Examples of the inorganic white pigments include a sulfate of alkali earth metals such as barium sulfate, a carbonate of alkali earth metals such as calcium carbonate, silicas such as fine silicic acid particles and synthetic silicate, calcium silicate, alumina, alumina hydrate, titanium oxide, metal compounds such as zinc oxide, talc, clay, and the like. Particularly, titanium oxide is known as a white pigment showing a preferable hiding property, coloring property, and dispersed particle diameter.

Examples of the organic white pigment include organic compound salts shown in JP-A-11-129613, and alkylene bismelamine derivatives shown in JP-A-11-140365 and JP-A-2001-234093. Specific examples of products of the organic white pigments include Shigenox OWP, Shigenox OWPL, Shigenox FWP, Shigenox FWG, Shigenox UL, Shigenox U (all product names, manufactured by HAKKOL CHEMICAL CO., LTD.), and the like. Examples of the white hollow resin particles include the particles that are substantially formed of organic polymers and show thermoplasticity, which are disclosed in the specification of U.S. Pat. No. 4,089,800.

Examples of the pigments usable for a white ink include C. I. Pigment White 6, 18, 21, and the like.

Examples of the pigments usable for a yellow ink include C. I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 150, 151, 153, 155, 154, 167, 172, 180, 185, 213, and the like.

Examples of the pigments usable for a magenta ink include C. I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48 (Ca), 48 (Mn), 57 (Ca), 57:1, 88, 112, 114, 122, 123, 144, 146, 149, 150, 166, 168, 170, 171, 175, 176, 177, 178, 179, 184, 185, 187, 202, 209, 219, 224, 245, and C. I. Pigment Violet 19, 23, 32, 33, 36, 38, 43, 50, and the like.

Examples of the pigments usable for a cyan ink include C. I. Pigment Blue 1, 2, 3, 15, 15:1, 15:2, 15:3, 15:34, 15:4, 16, 18, 22, 25, 60, 65, 66, and C. I. Vat Blue 4, 60, and the like.

Examples of pigments other than magenta, cyan, and yellow include C. I. Pigment Green 7, 10, C. I. Pigment Brown 3, 5, 25, 26, and C. I. Pigment Orange 1, 2, 5, 7, 13, 14, 15, 16, 24, 34, 36, 38, 40, 43, 63, and the like.

When the pigments are used in the present ink, the average particle diameter thereof is preferably in a range of from 10 nm to 200 nm, and more preferably in a range of from 50 nm to 150 nm. When the coloring materials are used in the ink, the amount of the coloring materials to be added is preferably in a range of about from 0.1% by mass to 25% by mass, and more preferably in a range of about from 0.5% by mass to 15% by mass. When the pigments are used in the ink, it is possible to use a pigment dispersion which is obtained by dispersing the pigment in a medium by using a dispersant or surfactant. As a preferable dispersant, a dispersant widely used for preparing a pigment dispersion, for example, a polymer dispersant can be used. When containing the coloring material, the ink may contain a plurality of coloring materials. For example, in addition to four basic colors such as yellow, magenta, cyan, and black, the ink can further contain special colors such as green, orange, blue, and white, and dark colors and light colors of the same shades can be added to the respective colors. That is, for example, light magenta as a light color as well as magenta, light cyan as a light color as well as cyan, dark red, dark blue, grey and light black as light colors as well as black, and mat black as a dark color can be contained in the ink.

Dye

In the embodiment, dyes can be used as coloring materials. As the dyes, various dyes that are generally used for ink jet recording, such as direct dyes, acidic dyes, edible dyes, basic dyes, reactive dyes, dispersed dyes, vat dyes, soluble vat dyes, and reactive dispersed dyes can be used without particular limitation. In the following specific examples, colors of oil dyes are described by being roughly classified into a blue shade, a red shade, and a yellow shade. In addition, neutral colors, that is, colors of a green shade and violet shade are described by being included in any of the classes.

Examples of the oil dyes of a blue shade include a polymethine dye such as an indoaniline dye, an indophenol dye, an azomethine dye having pyrrolotriazoles as coupling components, a cyanine dye, an oxonol dye, or a merocyanine dye, carbonium dyes such as a diphenylmethane dye, a triphenylmethane dye, and a xanthene dye, a phthalocyanine dye, an anthraquinone dye, an aryl or heteryl azo dye having phenols, naphthols, and anilines as coupling components, an indigo/thioindigo dye, and the like.

Specific examples of the oil dyes of a blue shade include Macrolex Blue RR and FR (manufactured by Bayer AG), Sumiplast green G (manufactured by Sumitomo Chemical Co., Ltd.), Vali Fast Blue 2606 and Oil BlueBOS (manufactured by Orient Chemical Industries Co., Ltd.), Aizen Spilon Blue GNH (manufactured by HODOGAYA CHEMICAL CO., LTD.), Neopen Blue 808, Neopen Blue FF4012 and Neopen Cyan FF4238 (manufactured by BASF), Oil Violet #730 (manufactured by Orient Chemical Industries Co., Ltd.), C. I. Solvent Blue-2, -11, -25, -35, -38, -43, -67, -70, -134, C. I. Solvent Green-1, -3, -7, -20, -33, C. I. Solvent Violet-2, -3, -11, -47, and the like.

Examples of the oil dyes of a red shade include an aryl or heteryl azo dye having phenols, naphthols, and anilines as coupling components, an azomethine dye having pyrazolones and pyrazolotriazoles as coupling components, a methine dye such as an anilidene dye, a styryl dye, a merocyanine dye, or an oxonol dye, a carbonium dye such as a diphenylmethane dye, a triphenylmethane dye, or a xanthene dye, a quinone-based dye such as naphthoquinone, anthraquinone, or anthrapyridone, a condensed polycyclic dye such as a dioxazine dye, and the like.

Specific examples of the oil dye of a red shade include Oil Red 5303 (manufactured by Arimoto Chemical Co., Ltd.), Oil Red 5B, Oil Pink 312, and Oil Scarlet 308 (manufactured by Orient Chemical Industries Co., Ltd.), Oil Red XO (manufactured by KANTO KAGAKU), Neopen Mazenta SE1378 (manufactured by BASF), Oil Brown GR (Orient Chemical Industries Co., Ltd.), C. I. Solvent Red-1, -3, -8, -18, -24, -27, -43, -49, -51, -72, -73, -109, -111, -229, -122, -132, -219, C. I. Solvent Brown-1, -12, -58, ORASET RED BG (manufactured by Ciba Specialty Chemicals Corporation), and the like.

Examples of the oil pigment of a yellow shade include an aryl or heteryl azo dye having phenols, naphthols, anilines, pyrazolones, pyridones, and chain-opening type active methine compounds as coupling components; an azomethine dye having chain-opening type active methine compounds as coupling components; a methine dye such as a benzylidene dye or a monomethine oxonol dye; and a quinone-based dye such as a naphthoquinone dye or an anthraquinone dye. In addition, examples of yellow dyes other than the above dyes include a quinophthalone dye, a nitro/nitroso dye, an acridine dye, an acridinone dye, and the like.

Specific examples of the oil dye of a yellow shade include Oil Yellow 3G, Oil Yellow 129, and Oil Yellow 105 (manufactured by Orient Chemical Industries Co., Ltd.), First Orange G and Neopen Yellow 075 (manufactured by BASF), ORASET YELLOW 3GN (manufactured by Ciba Specialty Chemicals Corporation), C. I. Solvent Yellow-1, -14, -16, -19, -25:1, -29, -30, -56, -82, -93, -162, -172, C. I. Solvent Orange-1, -2, 40:1, -99, and the like.

The ink composition can contain a plurality of the above dyes in combination. When a plurality of the dyes are combined, a combination that becomes an achromatic color is generated in some cases.

Specific examples of black oil dyes are described below.

Specific examples of dyes of a black shade include Sudan Black X60 (manufactured by BASF), Nubian Black PC-0850 and Oil Black HBB (manufactured by Orient Chemical Industries Co., Ltd.), C. I. Solvent Black-3, -7, -22:1, -27, -29, -34, -50, and the like.

The content of the coloring material is preferably 0.1% by mass to 25% by mass, and more preferably 0.5% by mass to 15% by mass, based on the total amount (100% by mass) of the specific ink.

The specific ink containing the above coloring materials is a color ink. Meanwhile, the specific ink (clear ink) that is colorless and transparent and does not contain the coloring materials can be composed in the same manner as the color ink, except that this ink does not contain the coloring materials.

Dispersant

When the ink of the embodiment contains pigments, the ink preferably contains a dispersant to improve pigment dispersibility. The dispersant is not particularly limited, and the examples thereof include dispersants that are widely used for preparing a pigment dispersion, such as polymer dispersants. Specific examples of the dispersant include dispersants having, as main components, one or more kinds of polyoxyalkylene polyalkylene polyamine, a vinyl-based polymer and copolymer, an acryl-based polymer and copolymer, polyester, polyamide, polyimide, polyurethane, an amino-based polymer, a silicon-containing polymer, a sulfur-containing polymer, a fluorine-containing polymer, and an epoxy resin. Examples of commercially available products of the polymer dispersant include Ajisper series manufactured by Ajinomoto Fine-Techno Co., Inc., Solsperse series manufactured by Avecia, Disperbyk series manufactured by BYKChemie, Disparlon series manufactured by KUSUMOTO CHEMICALS, Ltd., and the like.

The content of the dispersant is 5% by mass to 200% by mass, and preferably 30% by mass to 120% by mass, based on the total amount (100% by mass) of the specific ink. The content may be appropriately selected according to the coloring material to be dispersed.

Fixing Resin

The specific ink of the embodiment may contain a fixing resin. The fixing resin is not particularly limited, and examples thereof include an acryl resins manufactured from at least any one of acrylic acid ester and methacrylic acid ester, a styrene-acryl resin that is a copolymer of the acryl resin and styrene, a rosin-modified resin, a terpene-based resin, a modified terpene resin, a polyester resin, a polyamide resin, an epoxy resin, a vinyl chloride resin, a vinyl chloride-vinyl acetate copolymer, a cellulose-based resin (for example, cellulose acetate butyrate, and hydroxypropyl cellulose), polyvinyl butyral, polyacryl polyol, polyvinyl alcohol, polyurethane, and a hydrogenated petroleum resin.

Non-aqueous emulsion type polymer particles (NAD=Non Aqueous Dispersion) can also be used as the fixing resin. The particles are a dispersion in which particles of a polyurethane resin, an acryl resin, or an acryl polyol resin are stably dispersed in an organic solvent. Examples of the polyurethane resin include Sanprene IB-501 and Sanprene IB-F370 manufactured by Sanyo Chemical Industries. Ltd., and examples of the acryl polyol resin include N-2043-60 MEX manufactured by Harima Chemicals. Inc.

In order to further improve the fixing property of the pigment with respect to the recording medium, the fixing resin is preferably added at 0.1% by mass to 10% by mass to the ink. If too much fixing resin is added, recording stability is not obtained, and if too little is added, the fixing property become insufficient.

Surfactant

The specific ink of the embodiment may contain surfactants. The surfactant is not particularly limited, and examples thereof preferably include silicone-based surfactants and acetylene glycol-based surfactants. As the silicone-based surfactant, polyester-modified silicone and polyether-modified silicone can be used, and specific examples thereof include BYK-337, BYK-347, BYK-348, BYK-UV 3500, 3510, 3530, and 3570 (manufactured by BYK Japan KK). Specific examples of the acetylene glycol-based surfactant include 2,4,7,9-tetramethyl-5-decyne-4,7-diol, 3,6-dimethyl-4-octyne-3,6-diol, 3,5-dimethyl-1-hexyn-3-ol, and the like. Examples of the commercially available products of these surfactants include Surfynol 104, 82, 465, 485, or TG (all available from Air Products and Chemicals. Inc.), Olfine STG and Olfine E1010 (manufactured by Nissin Chemical Industry CO., Ltd.), Nissan Nonion A-10R and A-13R (manufactured by NOF CORPORATION), Flowlen TG-740W and D-90 (manufactured by Kyoeisha Chemical Co., Ltd.), Emulgen A-90 and A-60 (manufactured by Kao Corporation), Noigen CX-100 (manufactured by Daiichi Kogyo Seiyaku Co., Ltd.), and the like.

These surfactants may be added alone or as a mixture. The surfactant is added preferably at 0.01% by mass to 5% by mass to the ink composition. In this configuration, wettability of the ink composition with respect to the recording medium is improved, and a rapid fixing property can be obtained.

Other Additives

As other additives, for example, an antifungal agent, preservative, rust-preventive agent, antioxidant, thickener, moisturizer, pH adjustor, and surface tension adjustor known in the related art may be used, but the invention is not limited thereto.

Since the specific ink of the embodiment is a non-aqueous ink that substantially does not contain water, water has not been particularly described.

As described above, according to the embodiment, it is possible to provide a recording method that is excellent in the fixing property, tackiness, and landing accuracy, and to provide a specific ink used for the method, which does not cause a problem in terms of safety, hygiene, and legal regulation.

Print Medium

The print medium used in the embodiment is a non-ink-absorptive or low-ink-absorptive print medium.

Among the print media, examples of the non-ink-absorptive print medium include a plastic film that is not surface-treated (that is, a film in which an ink-absorbing layer is not formed) for ink jet recording, and a medium in which a plastic is coated on a substrate such as paper or a plastic film is adhered to the substrate. Examples of the plastic referred herein include polyvinyl chloride (vinyl chloride), polyethylene terephthalate (PET), polycarbonate (PC), polystyrene (PS), polyurethane (PU), polyethylene (PE), polypropylene (PP), and the like. Examples of the low-ink-absorptive print medium include printing paper such as art paper, coating paper, and mat paper.

EXAMPLE

Hereinafter, the embodiment will be described in more detail based on examples and comparative examples, but the invention is not limited solely by the examples.

Material

The materials used in examples and comparative examples are as follows.

Pigment

- C. I. Pigment Violet 19 (abbreviated to "PV19" in tables)
- C. I. Pigment Yellow 213 (abbreviated to "PY213" in tables)
- C. I. Pigment Blue 15:3 (abbreviated to "PB15:3" in tables)
- Carbon Black (CB) MA77 (product name, manufactured by Mitsubishi Chemical Corporation) (abbreviated to "CB MA77" in tables)

Dispersant

- Polyester-based polymer Solsperse 32000 (product name, manufactured by Avecia) (abbreviated to "Sol32000" in tables)

Fixing Resin

- Vinyl chloride-vinyl acetate copolymer UCAR Solution Vinyl VROH (product name, manufactured by Union Carbide Corporation, molecular weight of 15000, Tg=65° C.) (abbreviated to "P(VC-VAc)" in tables)
- Polyacryl polyol resin emulsion N-2043-60 MEX (product name, manufactured by Harima Chemicals. Inc.) (abbreviated to "AP-e" in tables)

Surfactant

- BYK-UV 3500 (polyether-modified polydimethylsiloxane, manufactured by BYK Japan KK) (abbreviated to "BYK 3500" in tables)

Various Solvents

1. Glycol Ether-based Solvent
   - Propylene glycol dimethyl ether (abbreviated to "PGDME" in tables)
   - Propylene glycol monomethyl ether (abbreviated to "PGME" in tables)
   - Propylene glycol methyl ether acetate (abbreviated to "PGMEA" in tables)

Dipropylene glycol dimethyl ether (abbreviated to "DPGDME" in tables)

Diethylene glycol diethyl ether (abbreviated to "DEGDEE" in tables)

Triethylene glycol dimethyl ether (abbreviated to "GL-3" in tables)

Ethylene glycol monobutyl ether acetate (abbreviated to "EGBEA" in tables)

Dipropylene glycol propyl ether (abbreviated to "DPGPE" in tables)

Tetraethylene glycol dimethyl ether (Tetraglyme, abbreviated to "GL-4" in tables)

Polyethylene glycol monomethyl ether (abbreviated to "PEGME" in tables)

2. Non-protonic Polar Solvent

N-ethyl-2-pyrrolidone (abbreviated to "NEP" in tables)

Dimethyl sulfoxide (abbreviated to "DMSO" in tables)

N-methyl-2-pyrrolidone (abbreviated to "NMP" in tables)

γ-butyrolactone (abbreviated to "GBL" in tables)

1,3-dimethyl-2-imidazolidinone (abbreviated to "DMI" in tables)

2-pyrrolidone (abbreviated to "pyrrolidone" in tables)

γ-undecalactone (abbreviated to "GUL" in tables)

3. Other Organic Solvents

Methyl ethyl ketone (abbreviated to "MEK" in tables)

2-propanol (abbreviated to "propanol" in tables)

Cyclohexanone 1,2-hexanediol (abbreviated to "hexanediol" in tables)

Dipropylene glycol (abbreviated to "DPG" in tables)

Triethylene glycol (abbreviated to "TEG" in tables)

Examples 1 to 6, Comparative Examples 1 to 5, Reference Examples 1 and 2

Preparation of Specific Ink

First, the materials were mixed in the composition shown in the following Tables 1 and 2, thereby preparing inks A to K.

In Tables 1 and 2, a blank means that the material was not added, and the unit of numerical values is % by mass.

TABLE 1

| | | Boiling point | Ink A | Ink B | Ink C | Ink D | Ink E | Ink F |
|---|---|---|---|---|---|---|---|---|
| Pigment | PV19 | — | 4 | 4 | 4 | 4 | 4 | |
| | PY213 | — | | | | | | 4 |
| | PB15:3 | — | | | | | | |
| | CB MA77 | — | | | | | | |
| Dispersant | Sol 32000 | — | 2 | 2 | 2 | 2 | 2 | 2 |
| Fixing resin | P(VC-VAc) | — | 4 | 4 | 3 | 4 | | 4 |
| | AP-e | — | | | | | 4 | |
| Surfactant | BYK3500 | — | 0.5 | 0.5 | 0.5 | 0.5 | 0.5 | 0.5 |
| Glycol ether-based solvent | PGDME | 97 | | | | | | |
| | PGME | 120 | | | 20 | | | 10 |
| | PGMEA | 146 | | | | 19.5 | | |
| | DPGDME | 171 | | 25.5 | 14.5 | | | |
| | DEGDEE | 189 | 69.5 | | | 10 | 69.5 | 50 |
| | GL-3 | 216 | | | | | | 9.5 |
| | EGBEA | 217 | | 20 | 20 | 10 | | |
| | DPGPE | 230 | | 20 | 10 | 20 | | |
| | GL-4 | 275 | | | | 6 | | |
| | PEGME | 300 | | | | | | |
| Non-protonic polar solvent | NEP | 97 | | | | | | |
| | DMSO | 189 | | | | | | |
| | NMP | 202 | | 20 | 6 | | | |
| | GBL | 203 | 20 | | 20 | | 20 | 20 |
| | DMI | 225 | | | | 20 | | |
| | Pyrrolidone | 250 | | | | | | |
| | GUL | 286 | | | | | | |
| Other organic solvent | MEK | 80 | | | | | | |
| | Propanol | 82 | | | | 4 | | |
| | Cyclo-hexanone | 156 | | 4 | | | | |
| | Hexanediol | 223 | | | | | | |
| | DPG | 245 | | | | | | |
| | TEG | 285 | | | | | | |
| Ultrapure water | | 100 | | | | | | |
| Total | | | 100 | 100 | 100 | 100 | 100 | 100 |
| (Note 1) | | | 89.5 | 85.5 | 90.5 | 79.5 | 89.5 | 89.5 |

(Note 1:
total of glycol ethers and non-protonic polar solvents having boiling point of 120° C. to 240° C.)

TABLE 2

| | | Boiling point | Ink G | Ink H | Ink I | Ink J | Ink K |
|---|---|---|---|---|---|---|---|
| Pigment | PV19 | — | | | | | |
| | PY213 | — | | | | | |
| | PB15:3 | — | 4 | | | | |
| | CB MA77 | — | | 8 | | | |
| Dispersant | Sol 32000 | — | 2 | 3 | 2 | 2 | 2 |
| Fixing resin | P(VC-VAc) | — | 4 | 7 | 4 | 4 | 4 |
| | AP-e | — | | | | | |
| Surfactant | BYK3500 | — | 0.5 | 0.5 | 0.5 | 0.5 | 0.5 |
| Glycol ether-based solvent | PGDME | 97 | | | | 69.5 | |
| | PGME | 120 | 10 | | | | |
| | PGMEA | 146 | | | | | |
| | DPGDME | 171 | | 10 | | | |

TABLE 2-continued

| | | Boiling point | Ink G | Ink H | Ink I | Ink J | Ink K |
|---|---|---|---|---|---|---|---|
| | DEGDEE | 189 | 59.5 | 30 | | | 37 |
| | GL-3 | 216 | | | | | |
| | EGBEA | 217 | | | | | |
| | DPGPE | 230 | | | | | |
| | GL-4 | 275 | | 8 | | | |
| | PEGME | 300 | | 5 | 69.5 | | 24.5 |
| Non-protonic polar solvent | NEP | 97 | | | | 20 | |
| | DMSO | 189 | | 20 | | | |
| | NMP | 202 | | | | | |
| | GBL | 203 | 20 | | | | 18 |
| | DMI | 225 | | | | | |
| | Pyrrolidone | 250 | | | 5 | | |
| | GUL | 286 | | | 15 | | 10 |
| Other organic solvent | MEK | 80 | | 4.5 | | | |
| | Propanol | 82 | | | | | |
| | Cyclo-hexanone | 156 | | 4 | | | |
| | Hexanediol | 223 | | | | | |
| | DPG | 245 | | | | | |
| | TEG | 285 | | | | | |
| Ultrapure water | | 100 | | | | | |
| Total | | | 100 | 100 | 100 | 100 | 100 |
| (Note 1) | | | 89.5 | 60 | 0 | 0 | 55 |

(Note 1:
total of glycol ethers and non-protonic polar solvents having boiling point of 120° C. to 240° C.)

Printing

Next, inks A to K in the above Tables 1 and 2 were respectively printed on the following print media by using the following printer.

Print Medium

Vinyl chloride film (manufactured by Roland DG Corporation, product name "LLEX")

PP film (manufactured by Avery Dennison Corporation, product name "BA 2076")

PET film (manufactured by Lintec Corporation, product name "K 2411")

PE film (manufactured by Avery Dennison Corporation, product name "BA 1201")

Printing paper (manufactured by Oji Paper Company, Limited, product name "OK Top Coat +"

Printer (Printing Method)

1. Printer 1

A printer having the same basic configuration as shown in FIG. 2 was used. Here, the nozzle density in the nozzle column of the head was 180 dpi. The head 40 was caused to scan the print medium stopping in the hot platen 23 by a predetermined number of passes, thereby forming an image by one printing operation.

2. Printer 2 (serial printer)

EPSON PX-7500 (manufactured by Seiko Epson Corporation) was used. The platen was altered so as to be able to heat the print medium on the platen, and a heater was installed at the platen. The length in the print medium-transporting direction of the platen was almost the same as the length in the transporting direction of the head. The ink of the present example was filled in one of a plurality of nozzle columns of the head, thereby performing printing. The nozzle density of the nozzle column was 180 dpi. During the printing, main scanning and transporting (sub-scanning) of the print medium were alternatively repeated, thereby performing interlace printing of 4-pass printing. A certain point of the print medium was at a position facing the head, while the head performed 4 passes of main scanning.

The printing methods, temperature of the hot platen (platen temperature), number of times of scanning (pass number), resolution of images (printing resolution), and print medium used in each experiment example of Examples 1 to 6, Comparative Examples 1 to 5, and Reference Examples 1 and 2 are organized in the following Tables 3 and 4. In Examples 3 and 4, dots are formed in one pixel column that is a column of pixels lining up in the main scanning direction, by scanning (passing) twice.

TABLE 3

| | Example 1 | Example 2 | Example 3 | Example 4 | Example 5 | Example 6 | Example 7 |
|---|---|---|---|---|---|---|---|
| Specific ink | Ink A | Ink A | Ink A | Ink A | Ink A | Ink A | Ink B |
| Printing method | Printer 1 | Printer 1 | Printer 1 | Printer 1 | Printer 1 | Printer 1 | Printer 1 |
| Platen temperature | 60 | 60 | 60 | 60 | 30 | 80 | 60 |
| Number of times of scanning | 2-pass | 4-pass | 8-pass | 16-pass | 4-pass | 4-pass | 4-pass |
| Printing resolution | 360 × 360 | 720 × 720 | 720 × 720 | 1440 × 1440 | 720 × 720 | 720 × 720 | 720 × 720 |

| | Example 8 | Example 9 | Example 10 | Example 11 | Example 12 | Example 13 |
|---|---|---|---|---|---|---|
| Specific ink | Ink C | Ink D | Ink E | Ink F | Ink G | Ink H |
| Printing method | Printer 1 | Printer 1 | Printer 1 | Printer 1 | Printer 1 | Printer 1 |
| Platen temperature | 60 | 60 | 60 | 60 | 60 | 60 |
| Number of times of scanning | 4-pass | 4-pass | 4-pass | 4-pass | 4-pass | 4-pass |
| Printing resolution | 720 × 720 | 720 × 720 | 720 × 720 | 720 × 720 | 720 × 720 | 720 × 720 |

TABLE 4

| | Comparative Example 1 | Comparative Example 2 | Comparative Example 3 | Comparative Example 4 | Comparative Example 5 | Reference Example 1 | Reference Example 2 |
|---|---|---|---|---|---|---|---|
| Specific ink | Ink A | Ink I | Ink J | Ink K | Ink A | Ink A | Ink A |
| Printing method | Printer 2 | Printer 1 | Printer 1 | Printer 1 | Printer 1 | Printer 1 | Printer 1 |
| Platen temperature | 60 | 60 | 60 | 60 | 60 | 20 | 90 |
| Number of time of scanning | 4-pass | 4-pass | 4-pass | 4-pass | 1-pass | 4-pass | 4-pass |
| Printing resolution | 720 × 720 | 720 × 720 | 720 × 720 | 720 × 720 | 180 × 180 | 720 × 720 | 720 × 720 |

Evaluation Item

Evaluation 1: Bleeding

Characters of 4 pt and 10 pt were printed on the print media with the respective specific inks, on the platen heated to the temperature shown in the tables, followed by sufficiently heating so as to be dried, thereby forming samples. Subsequently, the state of bleeding (bleeding of characters, degree of recognizing characters) of the respective specific inks was visually observed. The evaluation criteria are shown below, and the evaluation results are shown in the following Tables 5 to 14.

A: None of the characters of 4 pt and 10 pt showed bleeding, and the characters were recognizable.

B: The characters of 4 pt and 10 pt showed slight bleeding, but the characters were recognizable.

C: The characters of 4 pt showed serious bleeding and were unrecognizable as characters. The characters of 10 pt showed bleeding but were recognizable as characters.

D: Both the characters of 4 pt and 10 pt showed serious bleeding and were not recognizable as characters.

As a factor of the bleeding, the drying property of the ink can be cited.

Evaluation 2: Solid Filling

Solid printing was performed on the print media with the respective specific inks, on the platen heated to the temperature shown in the tables, followed by sufficiently heating so as to be dried, thereby forming samples. Subsequently, the existence and degree of white streaks in the obtained resultant of solid printing were visually observed. The evaluation criteria are shown below, and the evaluation results are shown in the following Tables 5 to 14.

A: No cissing was observed in the entire printing area, and solid filling was excellent.

B: Though density variation was observed in a portion of the printing area, no cissing was observed in the entire printing area, and solid filling was also excellent, which is thus unproblematic.

C: Cissing was observed in a portion of the printing area, and solid filling was uneven.

D: Cissing was observed in almost entire printing area, and there was no solid filling.

As a factor of the solid filling, surface tension of the ink on the print medium can be cited.

Evaluation 3: Fixing property

The respective specific inks were solid-printed on the print media. Subsequently, a degree of adhesion between the surface of the print media and the printed layer was observed. Specifically, a cellophane tape (CT 24, manufactured by NICHIBAN CO., LTD,) was attached to a printout having the printed layer with the ball of a finger, and then results observed when the tape was peeled were evaluated based on the following criteria. The evaluation results are shown in the following Tables 5 to 14.

A: Printout was not peeled by the tape.

B: Though a portion of the printout was peeled by the tape, this was at an unproblematic level.

C: More than half of the printout was peeled.

As factors of the fixing property, the drying property of the ink and solubility with respect to vinyl chloride (responsiveness to vinyl chloride film) as a material of the print medium can be cited.

Evaluation 4: Tackiness

The respective specific inks were solid-printed on the print media. The tackiness immediately after printing, that is, whether or not a trace remained when the printout was touched with a finger was observed. The "immediately after printing" refers to a time immediately after the medium is discharged to the downstream of transport direction from the printing area, in a case of the printer 1. In a case of the printer 2 (serial printer), the term refers to a time immediately after the medium is discharged to the downstream of the transport direction from the platen (a portion facing the head). The evaluation criteria are shown below, and the evaluation results are shown in the following Tables 5 to 14.

A: A trace of a finger did not remain in a printout.

B: A trace of a finger slightly remained on a printout, but ink was not transferred to the finger.

C: A trace of a finger remained seriously, and ink was transferred to the finger.

As a factor of the tackiness, the drying property of the ink can be cited. When the solvent contained in the ink almost completely volatilizes, the trace does not remain when the printout is touched with a finger (tack free).

Evaluation 5: Landing accuracy

By using a printing pattern in which each nozzle records one dot at an interval of 1 mm in the main scanning direction, printing was performed in the conditions shown in the table. The intervals between printed dots were measured, thereby calculating landing errors. The evaluation criteria are shown below, and the evaluation results are shown in the following Tables 5 to 14.

A: Landing error was within ±5 μm.

B: Landing error was within ±20 μm.

C: Landing error was ±20 μm or greater.

The error of the landing position accuracy was within ±5 μm. In addition, as factors of the landing accuracy, a transporting property of the print medium and the recording method can be cited.

TABLE 5

[Results in vinyl chloride film]

| | Example 1 | Example 2 | Example 3 | Example 4 | Example 5 | Example 6 | Example 7 |
|---|---|---|---|---|---|---|---|
| Bleeding | A | A | A | A | B | A | A |
| Solid filling | A | A | A | A | B | A | A |
| Fixing property | A | A | A | A | A | A | A |
| Tackiness | A | A | A | A | B | A | A |
| Landing accuracy | A | A | A | A | A | A | A |

| | Example 8 | Example 9 | Example 10 | Example 11 | Example 12 | Example 13 |
|---|---|---|---|---|---|---|
| Bleeding | A | A | A | A | A | A |
| Solid filling | A | A | A | A | A | A |
| Fixing property | A | A | A | A | A | A |
| Tackiness | A | A | A | A | A | A |
| Landing accuracy | A | A | A | A | A | A |

TABLE 6

[Results in vinyl chloride film (continued)]

| | Comparative Example 1 | Comparative Example 2 | Comparative Example 3 | Comparative Example 4 | Comparative Example 5 | Reference Example 1 | Reference Example 2 |
|---|---|---|---|---|---|---|---|
| Bleeding | A | D | A | C | C | D | A |
| Solid filling | A | D | A | C | C | D | A |
| Fixing property | A | C | A | C | A | B | A |
| Tackiness | C | C | A | C | C | C | A |
| Landing accuracy | C | A | C | A | C | A | A |

TABLE 7

[Results in PP film]

| | Example 1 | Example 2 | Example 3 | Example 4 | Example 5 | Example 6 | Example 7 |
|---|---|---|---|---|---|---|---|
| Bleeding | A | A | A | A | B | A | A |
| Solid filling | A | A | A | A | A | A | A |
| Fixing property | A | A | A | A | A | A | A |
| Tackiness | A | A | A | A | B | A | A |
| Landing accuracy | A | A | A | A | A | A | A |

| | Example 8 | Example 9 | Example 10 | Example 11 | Example 12 | Example 13 |
|---|---|---|---|---|---|---|
| Bleeding | A | A | A | A | A | A |
| Solid filling | A | A | A | A | A | A |
| Fixing property | A | A | A | A | A | A |
| Tackiness | A | A | A | A | A | A |
| Landing accuracy | A | A | A | A | A | A |

TABLE 8

[Results in PP film (continued)]

| | Comparative Example 1 | Comparative Example 2 | Comparative Example 3 | Comparative Example 4 | Comparative Example 5 | Reference Example 1 | Reference Example 2 |
|---|---|---|---|---|---|---|---|
| Bleeding | A | D | A | C | C | D | A |
| Solid filling | A | D | A | C | C | D | A |
| Fixing property | A | C | A | C | A | B | A |
| Tackiness | C | C | A | C | C | C | A |
| Landing accuracy | C | A | C | A | C | A | A |

TABLE 9

[Results in PET film]

| | Example 1 | Example 2 | Example 3 | Example 4 | Example 5 | Example 6 | Example 7 |
|---|---|---|---|---|---|---|---|
| Bleeding | A | A | A | A | B | A | A |
| Solid filling | A | A | A | A | A | A | A |
| Fixing property | A | A | A | A | A | A | A |
| Tackiness | A | A | A | A | B | A | A |
| Landing accuracy | A | A | A | A | A | A | A |

| | Example 8 | Example 9 | Example 10 | Example 11 | Example 12 | Example 13 |
|---|---|---|---|---|---|---|
| Bleeding | A | A | A | A | A | A |
| Solid filling | A | A | A | A | A | A |
| Fixing property | A | A | A | A | A | A |
| Tackiness | A | A | A | A | A | A |
| Landing accuracy | A | A | A | A | A | A |

TABLE 10

[Results in PET film (continued)]

| | Comparative Example 1 | Comparative Example 2 | Comparative Example 3 | Comparative Example 4 | Comparative Example 5 | Reference Example 1 | Reference Example 2 |
|---|---|---|---|---|---|---|---|
| Bleeding | A | D | A | C | C | D | A |
| Solid filling | A | D | A | C | C | D | A |
| Fixing property | A | C | A | C | A | B | A |
| Tackiness | C | C | A | C | C | C | A |
| Landing accuracy | C | A | C | A | C | A | A |

TABLE 11

[Results in PE film]

| | Example 1 | Example 2 | Example 3 | Example 4 | Example 5 | Example 6 | Example 7 |
|---|---|---|---|---|---|---|---|
| Bleeding | A | A | A | A | B | A | A |
| Solid filling | A | A | A | A | A | A | A |
| Fixing property | A | A | A | A | A | A | A |
| Tackiness | A | A | A | A | B | A | A |
| Landing accuracy | A | A | A | A | A | B | A |

| | Example 8 | Example 9 | Example 10 | Example 11 | Example 12 | Example 13 |
|---|---|---|---|---|---|---|
| Bleeding | A | A | A | A | A | A |
| Solid filling | A | A | A | A | A | A |
| Fixing property | A | A | A | A | A | A |
| Tackiness | A | A | A | A | A | A |
| Landing accuracy | A | A | A | A | A | A |

TABLE 12

[Results in PE film (continued)]

| | Comparative Example 1 | Comparative Example 2 | Comparative Example 3 | Comparative Example 4 | Comparative Example 5 | Reference Example 1 | Reference Example 2 |
|---|---|---|---|---|---|---|---|
| Bleeding | A | D | A | C | C | D | A |
| Solid filling | A | D | A | C | C | D | A |
| Fixing property | A | C | A | C | A | B | A |
| Tackiness | C | C | A | C | C | C | A |
| Landing accuracy | C | A | C | A | C | A | C |

TABLE 13

[Results in printing paper]

| | Example 1 | Example 2 | Example 3 | Example 4 | Example 5 | Example 6 | Example 7 |
|---|---|---|---|---|---|---|---|
| Bleeding | A | A | A | A | B | A | A |
| Solid filling | A | A | A | A | A | A | A |
| Fixing property | A | A | A | A | A | A | A |
| Tackiness | A | A | A | A | B | A | A |
| Landing accuracy | A | A | A | A | A | A | A |

| | Example 8 | Example 9 | Example 10 | Example 11 | Example 12 | Example 13 |
|---|---|---|---|---|---|---|
| Bleeding | A | A | A | A | A | A |
| Solid filling | A | A | A | A | A | A |
| Fixing property | A | A | A | A | A | A |
| Tackiness | A | A | A | A | A | A |
| Landing accuracy | A | A | A | A | A | A |

TABLE 14

[Results in printing paper (continued)]

| | Comparative Example 1 | Comparative Example 2 | Comparative Example 3 | Comparative Example 4 | Comparative Example 5 | Reference Example 1 | Reference Example 2 |
|---|---|---|---|---|---|---|---|
| Bleeding | A | D | A | C | C | D | A |
| Solid filling | A | D | A | C | C | D | A |
| Fixing property | A | C | A | C | A | B | A |
| Tackiness | C | C | A | C | C | C | A |
| Landing accuracy | C | A | C | A | C | A | A |

To compare the results based on the printing media, three media including the vinyl chloride film, PP film, and PET film yielded the same results. On the other hand, the PE film having slightly poor heat resistance resulted in poor landing accuracy as this media was deformed.

As shown in the Tables 3 and 4, it was found that, in the printer 1 equipped with a platen heater, by using the non-aqueous specific ink containing 60% by mass or more of one or more kinds of organic solvent that have a boiling point of 120° C. to 240° C. and are selected from a group consisting of glycol ether-based solvents and non-protonic polar solvents in the ink composition, a recording method that is excellent in terms of the fixing property, tackiness, and landing accuracy can be obtained.

Particularly, regarding a printing method, it became clear that the printing method of the invention is more excellent than the serial method. In the present printing method, the print medium is held on the platen until printing is completed. As a result, since the printing medium is heated sufficiently, the drying property immediately after the printing can be further improved compared to the serial method, even if the specific ink containing organic solvents having a high boiling point is used.

It was also found that, in the printing method of the invention, there were no errors in transporting paper during printing, compared to the serial method. Accordingly, landing accuracy could be improved, and image quality was excellent.

In addition, it was confirmed that, in the printing method of the invention, the number of passes for printing could be changed, and printing properties such as printing speed, image quality, and the drying property could be adjusted according to the types of the ink and print medium, unlike the serial method.

The entire disclosure of Japanese Patent Application No: 2011-024330, filed Feb. 7, 2011 is expressly incorporated by reference herein.

What is claimed is:

1. An ink jet recording method comprising:

forming an image on a print medium positioned in a printing area by discharging a specific ink; and in the forming of an image, a print head performs a scanning in which the print head moves in a predetermined direction relative to the stationary print medium on a platen heated to a temperature of 30° C. to 80° C. equipped with a drying mechanism and discharges the specific ink from the print head to the print medium; wherein the scanning is performed a plurality of times;

between scanning and scanning an operation of moving the print head in a direction crossing the predetermined direction is performed;

throughout the forming of an image the print medium is not transported but held in the printing area;

the specific ink discharged to the print medium is fixed to the print medium by being supplied with energy;

the print medium is a non-ink-absorptive or low-ink-absorptive print medium; and the specific ink contains 60% by mass or more of one or more kinds of organic solvent that have a boiling point of 120° C. to 240° C. and are selected from a group consisting of glycol ether-based solvents and non-protonic polar solvents in the ink composition.

2. The ink jet recording method according to claim 1, wherein in the forming of an image, scanning for moving the print head in the predetermined direction, and the operation of moving the print head relative to the print medium in the direction crossing the predetermined direction are alternatively performed.

3. An ink used for the ink jet recording method according to claim 2.

4. The ink jet recording method according to claim 1, wherein the print head is provided with nozzle columns in which a plurality of nozzles having a predetermined nozzle density line up, in the direction crossing the predetermined direction, and whenever the forming of an image is performed once, printing is performed with a printing resolution higher than the nozzle density of the print head in the direction crossing the predetermined direction.

5. An ink used for the ink jet recording method according to claim 4.

6. The ink jet recording method according to claim 1, wherein the print head is provided with nozzle columns in which a plurality of nozzles line up in the direction crossing the predetermined direction, and a length in the direction crossing the predetermined direction of the nozzle columns is longer than a length in the direction crossing the predetermined direction of the print medium positioned in the printing area.

7. An ink used for the ink jet recording method according to claim 6.

8. An ink used for the ink jet recording method according to claim 1.

9. The ink jet recording method according to claim 1, wherein the print head discharges the ink from each of the print head's nozzles in each of the plurality of times.

10. The ink jet recording method according to claim 1, wherein in each of the plurality of times, the print head discharges the ink across an entire width of the print medium.

11. The ink jet recording method according to claim 1, further comprising suctioning the print medium on the printing area using the hot platen so as to hold the print medium on the hot platen.

12. The ink jet recording method according to claim 1, further comprising receiving print data for a print job including an image;

wherein the print medium is not transported but held in the printing area throughout printing of the print job.

13. The ink jet recording method according to claim 12, wherein the print medium comprises a roll, and the method further comprises:

after printing the print job including the image, transporting the print medium in a transport direction; and receiving print data for a second print job including an image, the print medium not being transported but held in the printing area throughout printing of the second print job.

14. The ink jet recording method according to claim 1, wherein:

the print medium comprises a roll;

the image is formed on a first side of the print medium;

the energy is supplied to a second side of the print medium that is opposite the first side; and the method further comprises, after the forming of an image, transporting the print medium in a transport direction so as to move a second, different portion of the roll into the printing area for forming an image on the second, different portion of the roll in the printing area by discharging the specific ink.

15. The ink jet recording method according to claim 1, wherein the energy being applied to the specific ink includes heat.

16. The ink jet recording method according to claim 1, wherein the glycol ether-based solvents comprise one or more of ethylene glycol monomethyl ether, ethylene glycol monoethyl ether, ethylene glycol mono-n-butyl ether, ethylene glycol mono-tert-butyl ether, diethylene glycol monomethyl ether, diethylene glycol monoethyl ether, diethylene glycol monobutyl ether, propylene glycol monomethyl ether, propylene glycol monoethyl ether, propylene glycol monobutyl ether, dipropylene glycol monomethyl ether, dipropylene glycol monopropyl ether, ethylene glycol mono-2-ethylhexyl ether, ethylene glycol diethyl ether, ethylene glycol dibutyl ether, diethylene glycol ethylmethyl ether, diethylene glycol dimethyl ether, diethylene glycol diethyl ether, dipropylene glycol dimethyl ether, triethylene glycol dimethyl ether, alkylene glycol monoalkyl ether acetate.

* * * * *